US009504866B2

(12) United States Patent
Peralo

(10) Patent No.: US 9,504,866 B2
(45) Date of Patent: Nov. 29, 2016

(54) MULTIPLE USE EXERCISE APPARATUS

(71) Applicant: Charles A. Peralo, Rock Hill, NY (US)

(72) Inventor: Charles A. Peralo, Rock Hill, NY (US)

( * ) Notice: Subject to any disclaimer, the term of this patent is extended or adjusted under 35 U.S.C. 154(b) by 0 days.

(21) Appl. No.: 14/759,967

(22) PCT Filed: Aug. 5, 2014

(86) PCT No.: PCT/US2014/049658
§ 371 (c)(1),
(2) Date: Jul. 9, 2015

(87) PCT Pub. No.: WO2015/020984
PCT Pub. Date: Feb. 12, 2015

(65) Prior Publication Data

US 2015/0335935 A1 Nov. 26, 2015

Related U.S. Application Data

(60) Provisional application No. 61/863,675, filed on Aug. 8, 2013.

(51) Int. Cl.
*A63B 21/072* (2006.01)
*A63B 21/00* (2006.01)
(Continued)

(52) U.S. Cl.
CPC ..... *A63B 21/00061* (2013.01); *A63B 21/0004* (2013.01); *A63B 21/00043* (2013.01);
(Continued)

(58) Field of Classification Search
CPC ..... A63B 21/0004; A63B 21/00043; A63B 21/00061; A63B 21/00065; A63B 21/00181; A63B 21/00185; A63B 21/012; A63B 21/04; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/072; A63B 21/0722; A63B 21/0724; A63B 21/0726; A63B 21/0728; A63B 21/075; A63B 21/08; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/4015; A63B 21/4019; A63B 21/4023; A63B 21/4025; A63B 21/4033; A63B 21/4034; A63B 21/4035; A63B 21/4043; A63B 21/4047; A63B 21/4049; A63B 22/0046; A63B 22/20; A63B 22/201; A63B 22/203; A63B 23/0211; A63B 23/0216; A63B 23/0222; A63B 23/035; A63B 23/03508; A63B 23/03516; A63B 23/03525; A63B 23/03541; A63B 23/03575; A63B 23/04; A63B 23/0405; A63B 23/047; A63B 23/0482; A63B 23/0494; A63B 23/08; A63B 23/12; A63B 23/1209; A63B 23/1236; A63B 23/1245; A63B 23/1254; A63B 23/1263; A63B 23/1272; A63B 23/1281; A63B 2208/0295
See application file for complete search history.

(56) References Cited

U.S. PATENT DOCUMENTS 793,101 A * 6/1905 Schmidt ..... A61H 7/007 482/108
1,316,683 A * 9/1919 Calvert ..... A63B 21/072 473/125
(Continued)

OTHER PUBLICATIONS

Written Opinion and International Search Report dated Nov. 19, 2014, in PCT/US2014/049658.
International Preliminary Report on Patentability dated May 21, 2015, in PCT/US2014/049658.

*Primary Examiner* — Oren Ginsberg
*Assistant Examiner* — Gary D Urbiel Goldner
(74) *Attorney, Agent, or Firm* — David M. Quinlan, P.C.

(57) ABSTRACT

An exercise device capable of being used in multiple configurations with a plurality of accessories comprises a flat base, sidewalls extending upwardly from the base and spaced from each other, and a handle spanning the sidewalls for grasping by a user of the device. The base has a central hole therethrough to which weights can be mounted, and the handle is hollow for accepting a bar therein to which weights can also be mounted. The undersurface of the base can be coated with a non-friction material to facilitate gliding of the device. An elastic exercise band or rope pulley can be attached to the base at the hole, and a foot strap can be attached at the hollow handle. A bar can extend through the hollow handles of two devices to secure them together to provide even greater versatility.

16 Claims, 16 Drawing Sheets

(51) Int. Cl.

| | |
|---|---|
| ***A63B 21/012*** | (2006.01) |
| ***A63B 23/04*** | (2006.01) |
| ***A63B 23/12*** | (2006.01) |
| ***A63B 22/20*** | (2006.01) |
| ***A63B 23/02*** | (2006.01) |
| ***A63B 23/035*** | (2006.01) |
| *A63B 21/055* | (2006.01) |

(52) U.S. Cl.

CPC ..... *A63B21/00065* (2013.01); *A63B 21/012* (2013.01); *A63B 21/072* (2013.01); *A63B 21/0722* (2015.10); *A63B 21/1469* (2013.01); *A63B 21/4015* (2015.10); *A63B 21/4035* (2015.10); *A63B 22/20* (2013.01); *A63B 23/0211* (2013.01); *A63B 23/0222* (2013.01); *A63B 23/03541* (2013.01); *A63B 23/04* (2013.01); *A63B 23/12* (2013.01); *A63B 23/1236* (2013.01); *A63B 21/00181* (2013.01); *A63B 21/0552* (2013.01); *A63B 21/0557* (2013.01); *A63B 21/0726* (2013.01); *A63B 21/4049* (2015.10); *A63B 23/1209* (2013.01); *A63B 23/1281* (2013.01); *A63B 2208/0295* (2013.01)

(56) References Cited

U.S. PATENT DOCUMENTS

| | | | | |
|---|---|---|---|---|
| 1,422,888 | A | 7/1922 | Reeves et al. | |
| 1,630,467 | A | 5/1927 | Bradstreet | |
| 2,617,650 | A * | 11/1952 | Landis | A63B 21/072 482/108 |
| 3,115,338 | A | 12/1963 | Acs et al. | |
| 4,252,316 | A * | 2/1981 | Price | A63B 21/0728 482/106 |
| 4,345,756 | A * | 8/1982 | Hoagland | A63B 21/075 482/108 |
| 4,351,525 | A | 9/1982 | Rozenblad | |
| 4,610,448 | A | 9/1986 | Hill | |
| 4,743,017 | A * | 5/1988 | Jaeger | A63B 21/075 482/108 |
| 4,854,573 | A | 8/1989 | Johannson et al. | |
| 4,997,184 | A | 3/1991 | Sherman | |
| 5,346,449 | A * | 9/1994 | Schlagel | A63B 21/0728 482/107 |
| D354,100 | S | 1/1995 | Tsay et al. | |
| 5,540,640 | A * | 7/1996 | Povilaitis | A63B 21/072 482/106 |
| 5,735,779 | A * | 4/1998 | Lay | A63B 21/072 482/93 |
| 5,967,948 | A * | 10/1999 | Carr | A63B 21/072 482/106 |
| 5,967,949 | A * | 10/1999 | Davenport | A63B 21/153 482/108 |
| D422,654 | S | 4/2000 | Chen | |
| D432,603 | S | 10/2000 | Bullard, Jr. | |
| 6,142,918 | A * | 11/2000 | Liu | A63B 21/072 16/430 |
| 6,196,951 | B1 * | 3/2001 | Shepherd | A63B 21/072 482/106 |
| 6,338,702 | B1 * | 1/2002 | Jordan | A63B 21/072 294/15 |
| 6,569,066 | B1 * | 5/2003 | Patterson | A63B 21/0552 482/106 |
| D479,289 | S | 9/2003 | Turner | |
| D523,493 | S | 6/2006 | Horton | |
| 7,097,601 | B1 * | 8/2006 | Ronnow | A63B 21/072 482/106 |
| 7,311,641 | B2 * | 12/2007 | Panagos | A63B 21/072 482/106 |
| 7,387,596 | B2 | 6/2008 | Towley, III et al. | |
| D580,998 | S | 11/2008 | Lin | |
| 7,468,025 | B2 | 12/2008 | Hauser et al. | |
| 7,491,157 | B1 * | 2/2009 | Lin | A63B 21/0728 482/107 |
| 7,503,884 | B1 * | 3/2009 | Schall | A63B 21/00047 482/115 |
| 7,678,031 | B2 | 3/2010 | Ngu | |
| 7,731,640 | B1 | 6/2010 | Chen | |
| 7,762,933 | B1 * | 7/2010 | Yu | A63B 21/072 482/106 |
| 7,896,777 | B2 * | 3/2011 | Huang | A63B 21/0724 482/108 |
| 7,896,789 | B2 * | 3/2011 | Hinton | A63B 21/00047 482/141 |
| D635,622 | S | 4/2011 | Martin et al. | |
| 7,976,443 | B2 | 7/2011 | Krull | |
| 8,002,678 | B1 | 8/2011 | Krull | |
| 8,025,613 | B1 | 9/2011 | Wang | |
| D654,544 | S * | 2/2012 | Sliemers | D21/662 |
| 8,118,717 | B1 | 2/2012 | Lai | |
| 8,157,713 | B1 * | 4/2012 | Siskowic | A63B 21/0004 482/141 |
| D662,997 | S * | 7/2012 | Su | D21/662 |
| 8,382,645 | B2 | 2/2013 | Mylrea et al. | |
| 8,403,818 | B1 | 3/2013 | Wilkinson et al. | |
| 8,480,547 | B2 | 7/2013 | Coates | |
| 8,702,574 | B2 | 4/2014 | Abranchess | |
| 9,132,312 | B2 * | 9/2015 | Henley | A63B 21/0726 |
| 2004/0063553 | A1 * | 4/2004 | Viscount | A63B 21/065 482/107 |
| 2004/0266592 | A1 * | 12/2004 | Leon | A63B 21/072 482/106 |
| 2004/0266593 | A1 | 12/2004 | Schwendeman | |
| 2006/0014615 | A1 | 1/2006 | Godbold | |
| 2006/0035771 | A1 | 2/2006 | Gant | |
| 2006/0040809 | A1 * | 2/2006 | Godbold | A63B 26/003 482/141 |
| 2007/0042879 | A1 * | 2/2007 | Panagos | A63B 21/072 482/106 |
| 2008/0081744 | A1 * | 4/2008 | Gormley | A63B 21/0728 482/93 |
| 2010/0130337 | A1 | 5/2010 | Stewart | |
| 2010/0222186 | A1 * | 9/2010 | Grand | A63B 21/075 482/107 |
| 2010/0317496 | A1 | 12/2010 | Abranchess | |
| 2011/0028285 | A1 * | 2/2011 | Towley, III | A63B 21/0728 482/108 |
| 2011/0071008 | A1 | 3/2011 | Coates | |
| 2011/0177922 | A1 * | 7/2011 | Selinger | A63B 21/0724 482/107 |
| 2011/0230313 | A1 | 9/2011 | Gamboa | |
| 2011/0263392 | A1 * | 10/2011 | Yu | A63B 21/072 482/93 |
| 2011/0312477 | A1 | 12/2011 | Wiseman | |
| 2012/0053024 | A1 * | 3/2012 | Mendoza | A63B 21/072 482/106 |
| 2012/0083396 | A1 * | 4/2012 | Aquino | A63B 21/0004 482/131 |
| 2012/0178597 | A1 | 7/2012 | Januszek | |
| 2012/0252641 | A1 * | 10/2012 | Odneal | A63B 21/072 482/108 |
| 2012/0258846 | A1 | 10/2012 | Wilson | |
| 2012/0295775 | A1 | 11/2012 | Reid | |
| 2013/0040788 | A1 * | 2/2013 | Booker | A63B 21/075 482/106 |
| 2013/0123079 | A1 | 5/2013 | Peritz et al. | |
| 2013/0210589 | A1 * | 8/2013 | Thompson | A63B 21/0726 482/108 |
| 2013/0244842 | A1 * | 9/2013 | Henley | A63B 21/0726 482/106 |
| 2014/0057764 | A1 * | 2/2014 | Klukas | A63B 15/00 482/109 |
| 2014/0194258 | A1 * | 7/2014 | Shorter | A63B 21/075 482/93 |

* cited by examiner

Figure 1
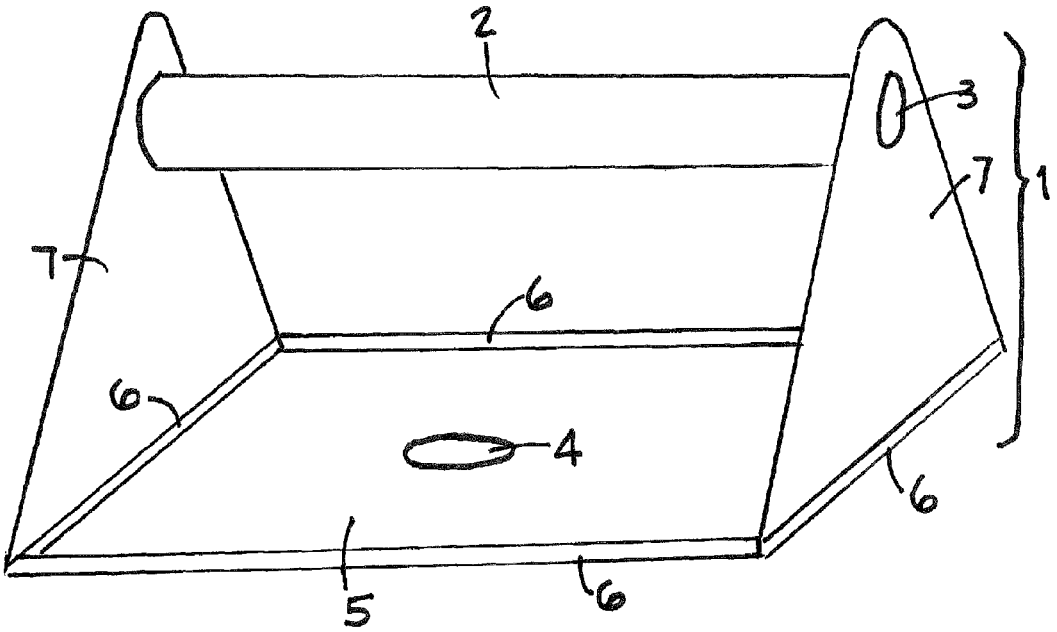
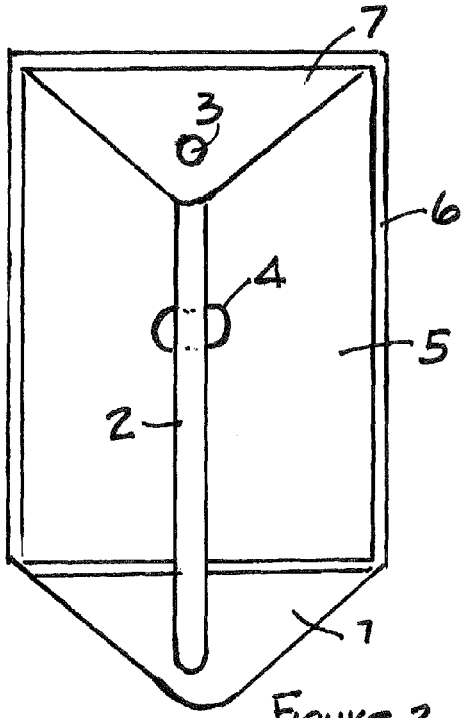
Figure 2

Figure 3
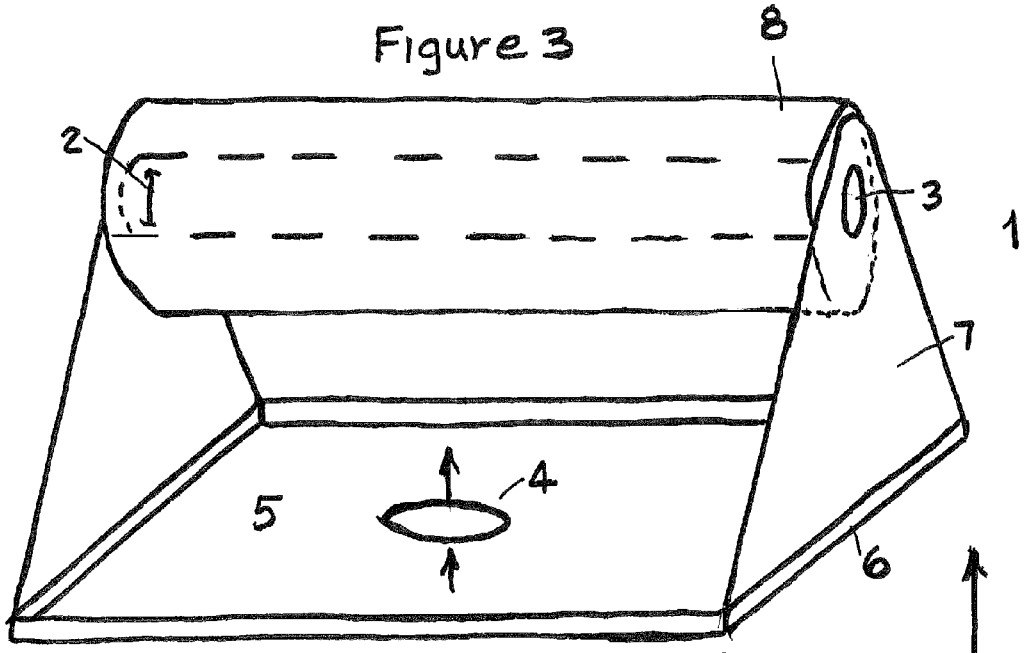
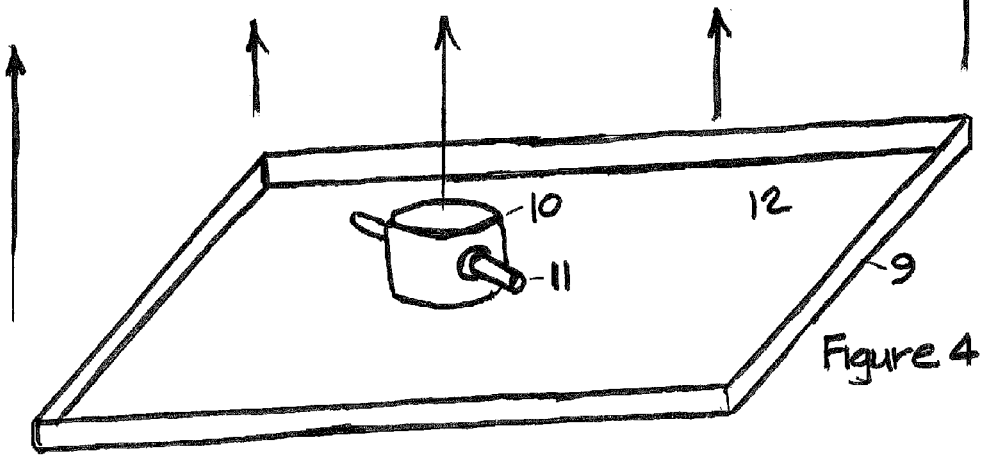
Figure 4
Figure 5
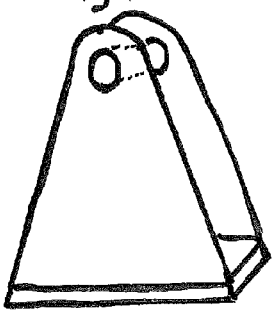
Figure 6
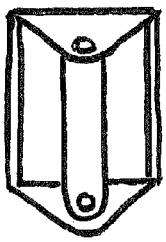
Figure 7
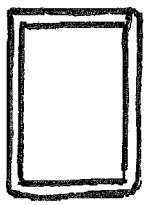
Figure 8
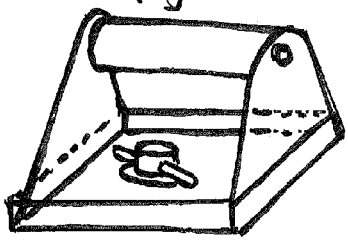

MULTIPLE USE EXERCISE APPARATUS

CROSS-REFERENCE TO RELATED APPLICATIONS

This application claims the benefit of U.S. provisional application No. 61/863,675, filed Aug. 8, 2013, the contents of which are incorporated herein by reference.

BACKGROUND OF THE INVENTION

1. Field of Invention

The present invention relates to a device that is a multiple use exercise device that can be used for both upper and lower extremity exercises. The device can be used by a handgrip for push-ups and upper and lower extremity gliding exercises. It can also be used for lower extremity exercises. In addition bar and bolt attachments, weights and exercise bands can be added to this device in a variety of configurations. These configurations include but are not limited to dumbbells, kettle bells, barbell, T-bar, curl bar and a rowing device.

2. Description of the Related Art

Exercise equipment varies greatly in many ways. Types of exercise equipment are generally described as cardiovascular or resistance type equipment. Cardiovascular equipment includes devices such as treadmills, exercise bikes, elliptical machines and other similar equipment. Resistance equipment includes devices such as weight machines (Nautilus®, Cybex®, Universal®, etc.), weight benches, free weights (dumbbells and barbells) and other similar equipment. The problem posed by this equipment is that it can be very expensive and require a large space for storage. Also most of this equipment lacks versatility. Many of these machines perform only one type of exercise and only concentrate on one part of the body. Home exercise devices have tried to minimize cost and size of the home equipment. However, much of this home equipment still lacks versatility. Many home devices only perform one type of exercise (cardiovascular or resistance) or only work on one body part (arms, legs, abdominals, etc). Also much of this home equipment lacks the ability to adjust the resistance of the exercises.

Some of the simplest home devices are push-up bars. Unfortunately, push-up bars perform a very limited type of exercises and work on very few muscle groups. Gliding exercise devices perform more exercises but are still limited in the types of exercises and body parts exercised. In addition, resistance cannot be adjusted using these devices. Devices of this nature that use either a push-up bar and/or gliding device have been shown in the following patents and publications.

| | | |
|---|---|---|
| U.S. Pat. No. 1,422,888 | U.S. Pat. No. 4,610,448 | U.S. Pat. No. 7,678,031 |
| U.S. Pat. No. 8,025,613 | U.S. Pat. No. 1,630,467 | U.S. Pat. No. 4,854,573 |
| U.S. Pat. No. 7,731,640 | U.S. Pat. No. 8,382,645 | U.S. Pat. No. 3,115,338 |
| U.S. Pat. No. 4,997,184 | U.S. Pat. No. 7,976,443 | U.S. Pat. No. 4,351,525 |
| U.S. Pat. No. 7,468,025 | U.S. Pat. No. 8,002,678 | U.S. Pub. 20100317496 |
| U.S. Pat. No. 8,403,818 | U.S. Pub. 20110312477 | U.S. Pub. 20060014615 |
| U.S. Pub. 20120178597 | U.S. Pub. 20120258846 | U.S. Pub. 20110230313 |
| U.S. Pub. 20110071008 | U.S. Pub. 20130123079 | U.S. Pat. No. D422654 |
| U.S. Pat. No. D580998 | U.S. Pat. No. D432603 | U.S. Pat. No. D635622 |
| U.S. Pat. No. D479289 | U.S. Pat. No. D354100 | U.S. Pat. No. D523493 |

Many of these devices use a gliding exercise regimen, generally lack versatility. One example is shown in U.S. Pat. No. 8,382,645. It uses a gliding device but does not incorporate handles. While U.S. Pub. 20110071008 incorporates handles with its gliding device it lacks the ability to adapt the gliding undersurface to different floor types. It also lacks diversity other than use in gliding exercises, U.S. Pub. 20110230313 is a gliding device that incorporates a handle and alternate gliding surfaces. This device also lacks the ability to perform exercises other than push-ups or gliding exercises. In addition the method of alternating the gliding undersurface with "hooks, snaps or magnets" is difficult and unstable.

Other prior art such as U.S. Pub. 20040266593 and 20060035771 use swivel push-up handles. These devices do not glide and only perform push-up exercises.

Patents such as U.S. Pat. No. 1,422,888 and U.S. Pat. No. 7,731,640 illustrate adjustable kettle bell devices. These devices can adjust the weight/resistance used but they only perform one type of exercise.

U.S. Pub. 20120295775 combines a dumbbell exerciser and a gliding exerciser. It utilizes rollers built into the dumbbell weights used. The drawback of this device is that the rollers only provide two directional motion (forward and backward) as opposed to a multidirectional gliding surface. In addition custom weight plates are needed as opposed to standard weights.

There are many types of push-up bars and gliding-type exercise devices. However, no previous device combines both a push-up bar and gliding device along with the use of free weights for dumbbells, kettle bells, barbell, curl bar, t-bar and rowing device. In addition no previous gliding device can be used for both upper and lower extremity and abdominal exercises in both resistance and cardiovascular exercise.

SUMMARY OF THE INVENTION

It is an object of the present invention to permit a user to perform a variety of exercises ranging from simple push-ups to an upper and lower extremity gliding exercises. The upper and lower extremity gliding exercises can be performed without or with free weights added through the handle of a push-up bar in accordance with one aspect of the invention. Exercise bands can also be connected in a variety of methods to either add resistance or assist in rebounding during gliding exercises. This device can be used on most household surfaces such as but not limited to carpet, wood, and tile floor (using either its primary undersurface or an accessory undersurface). A device according to one embodiment of the invention allows for a variety of different handgrips to allow for multiple different exercises.

The handle of the device is hollow so it can accept a standard dumbbell bar or similar type bar or bolt. Standard free weight plates can be added to these bars. A standard type dumbbell bar end clip (or similar clip, clasp, threaded nut or locking pin) can be used to secure the weights on the bar. Therefore, the device may be used as a push-up bar, gliding exercise device and a dumbbell. Other embodiments may use other methods of attaching a weight bar and weights.

The base of the device has a central hole to allow a bar or bolt (threaded or unthreaded) or even a dumbbell bar to slide through it. Standard free weight plates can be added to this bar/bolt making it an adjustable kettle bell exercise device. A standard type dumbbell bar end clip, threaded nut, clasp or locking pin can be used to secure the weights on the bar. In addition to this adjustable kettle bell the hollow handle of the device can be used to combine the kettle bell and dumbbell together in one device.

The device can also be used for lower extremity exercises. Free weights can be added either through the hollow handle (using a dumbbell bar) or through the central hole in the base (using a bolt or bar). The user can than put his foot in the device to perform a variety of lower extremity exercises. An optional heel strap may be added to help secure the foot in the device.

An exercise band can also be attached through the central hole in the base to convert the device to a rowing device. Weights may also be added through the handle to make it a weighted rowing handle.

Using the central opening a threaded or non-treated bar or bolt can be used to lock multiple weight plates between two of the handle devices making it a barbell for multiple exercises.

The sliding base of the device can also be removed for use on the user's feet for lower extremity exercises.

The device can also be used on the user's feet with weights added through the handle for lower extremity gliding exercises.

This summary is provided to introduce in a simplified form a selection of concepts relating to the subject matter described herein that are further described below in the Detailed Description of Exemplary Embodiments. It is not intended necessarily to identify key or essential features of the invention, nor as an aid in determining the scope of the claimed subject matter.

BRIEF DESCRIPTION OF THE DRAWINGS

The objects of the invention are not limited by the description above, and all of the objects and advantages of the invention will be better understood from the detailed description of its preferred embodiments which follows below, when taken in conjunction with accompanying drawings, in which like numerals and letters refer to like features throughout. The following is a brief identification of the drawing figures used in the accompanying detailed description.

FIG. 1 is an isometric view of a first embodiment of the exercise device. A frame made of metal or another similar sturdy material. A hollow handle with a triangular sidewall (but not limited to this particular shape) and a base covered with a gliding material such as but not limited to plastic, Teflon®, polished metal or felt.

FIG. 2 is an isometric view of the same device from a top view.

FIG. 3 is an isometric view of the exercise device. In this view a padded handle is added.

FIG. 4 is an isometric view of the accessory base used to change the gliding surface of the base. This is used to change the base from one that can be used on a carpet or similar surface to a firm surface such as but not limited to wood, tile and other hard surfaces. In another embodiment the primary base can be used on hard surfaces and the accessory base used on carpet. In another embodiment the alternate undersurface may be a non-slip surface such as (but not limited to) rubber to prevent the device from sliding if desired by the user.

FIG. 5 is an isometric view of the device from a side view.

FIG. 6 is an isometric view of the device from a top view.

FIG. 7 is an isometric view of the base and gliding surface of the device.

FIG. 8 is an isometric view of the device with the accessory base added.

DETAILED DESCRIPTION OF EXEMPLARY EMBODIMENTS

Figure 9:
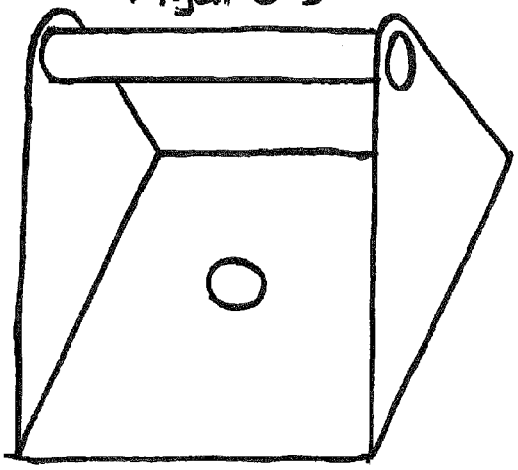
FIG. 9 is an isometric view of the device once again with an alternative separate gliding surface and fastening plug.

The detailed description that follows is intended to provide specific examples of particular embodiments illustrating various ways of implementing the claimed subject matter. It is written to take into account the level of knowledge of one of ordinary skill in the art to which the claimed subject matter pertains. Accordingly certain details may be omitted as being unnecessary for enabling such a person to realize the embodiment described herein. It will also be understood that terms indicating direction or orientation, such as "top," "bottom," "under," "over," etc., may be used to facilitate the description of these exemplary embodiments. The use of such terms does not imply that the claimed subject matter is limited to a particular orientation of the structure being described. When introducing elements of various embodiments of the present invention, the articles "a", "an" and "the", and the word "said" are intended to mean that there are one or more of the elements. The term "compromising", "including" and "having" are intended to be inclusive and mean that there may be additional elements other than those listed or specifically mentioned. Moreover, while the term "exemplary" may be used herein in connection with certain examples of aspects or embodiments of the presently disclosed technique, it will be appreciated that these examples are illustrative in nature and the term "exemplary" is not used herein to denote any preference or requirement with respect to a disclosed aspect or embodiment.

FIG. 1 is an isometric view of the exercise device 1 according to the first embodiment of the invention that can be useable in multiple applications, such as a push up bar and gliding exercise bar. It can also be used as is or in modified form as a kettle bell exercise device, a dumbbell, a barbell, a lower extremity exercise device, a rowing device along with other exercise regimens. It will be understood that the configuration and construction in FIG. 1 is exemplary in many respects and variations are possible to adapt the device to different applications. Some of those variations are described herein in connection with alternate embodiments. For example, adding weight bars and exercise bands to the device can adapt it to different exercise applications.

The exemplary device 1 in FIG. 1 includes a base 5 which in this embodiment is square or rectangular in shape. The shape is not exclusive to a square and in another embodiments another shape such as but not exclusive to a circle, oblong, or free form shape may be used. In this embodiment the opening 4 is circular in shape however the shape of the opening is not exclusive to a circle and may be a different shape in another embodiment or in another embodiment the opening may be omitted. Extended from the base 5 are two sidewalls one opposing the other. In this embodiment the sidewalls 7 are triangular in shape however the shape of the sidewalls is not exclusive to a triangle shape and may be a different shape in other embodiments. In this embodiment the apex of the triangle is rounded or cut off however in other embodiments this may not be necessary. Extending through the top of the triangle sidewall 7 and running parallel to the base 5 is a cylindrical tube handle 2. In this embodiment the tube 2 is hollow with openings on each of its ends 3 located near the top of the sidewall 7. In another embodiment the tube/handle 2 may be connected to the top of the sidewall instead of being cut through it. In another embodiment the tube/handle may be solid instead of hollow. Attached to the undersurface of the base 5 and extending and slightly overlapping the sides of the base and curved upward is a gliding surface 6. This gliding coating 6 of the undersurface of the base 5 is to consist of a gliding material such as but not exclusive to plastic, Teflon®, felt or similar materials. In another embodiment the undersurface may be a non-slip material or the coating may be omitted. The purpose of the gliding surface is to allow the device to glide easily on a variety of floor surfaces. The frame of the device including the base 5, sidewalls 7, and the handle 2 can be made of a sturdy material such as but not exclusive to steel, aluminum, or even some plastics sufficient to support the weight of an average human.

FIG. 2 is an isometric view of the exercise device 1 from an aerial viewpoint. Base 5, sidewalls 7, handle 2, base opening 4, handle opening 3 and the bass undersurface coating 6 are illustrated.

FIG. 3 is an isometric view of the exercise device 1. In this embodiment a padded surface 8 added to the handle 2 is illustrated. The padding 8 can envelope the circumference of the handle. The padding is made of material sufficient to comfortably pad the handle for the user. Material used for the padding can be, but not exclusive to rubber, neoprene or other padding material.

FIG. 4 is an isometric view of an accessory base 12 that may be fitted over the base 5 of the exercise device. The accessory base 12 fits over the base 5 of the device 1, as illustrated by the arrows, covering the undersurface of the device and slightly overlapping its sides (curved upward). A central plug 10 in the center of the accessory base 12 fits through the central opening 4 of the device 1. A locking bar or clip 11 running through the plug 10 may be used to lock the accessory base 12 in the base 5 of the device 1. In another embodiment the locking pin 11 may not be needed. The accessory base 12 is coated on its undersurface with a gliding surface 9. The gliding surface may be of a material such as but not exclusive to plastic, Teflon®, felt or similar material. The accessory base is provided to offer an alternative gliding surface other than that provided on the primary exercise device 1. For example, if the primary device 1 is coated on its undersurface with plastic (good for carpet) the accessory base 12 may be coated on its undersurface with felt (good for hard surface flooring). Therefore, a user can easily switch base coatings to adapt to different surfaces. In another embodiment the accessory base may be undercoated with a non-slip material such as but not exclusive to rubber to prevent the device 1 from sliding if desired by the user.

FIG. 5 is an isometric view of the exercise device 1 from a side view.

FIG. 6 is an isometric view of the exercise device 1 from an aerial view.

FIG. 7 is an isometric view of the exercise device 1 from the undersurface of its base 5 with undersurface coating 6'.

FIG. 8 is an isometric view of the exercise device 1 with the accessory base 12 added and locked on to it.

FIG. 9 is isometric view of the exercise device 1 from a front view. An alternative accessory gliding surface 13 is depicted with a concave recessed hole 14. The shape of the accessory surface is depicted as circular but it is not limited to this shape. An alternative method of locking it with a plug 15 is depicted.

Figure 10:
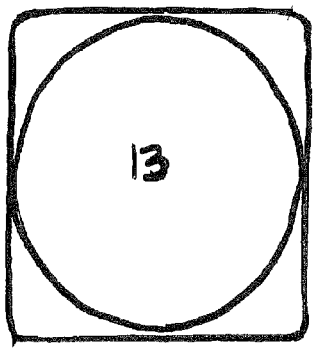
FIG. 10 is an isometric view of the undersurface of the device with the alternative gliding surface attached. In this view the alternative gliding surface is circular but it is not limited to this shape.
Figure 10:
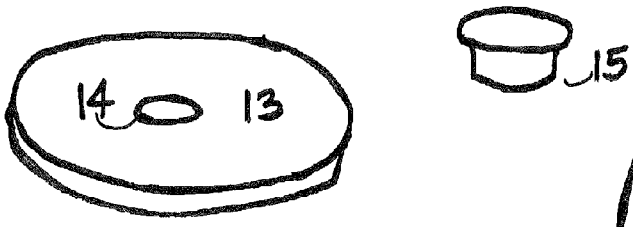

FIG. 10 is an isometric view of the exercise device from a bottom view of the base with the alternative gliding surface 13 attached.

Figure 11:
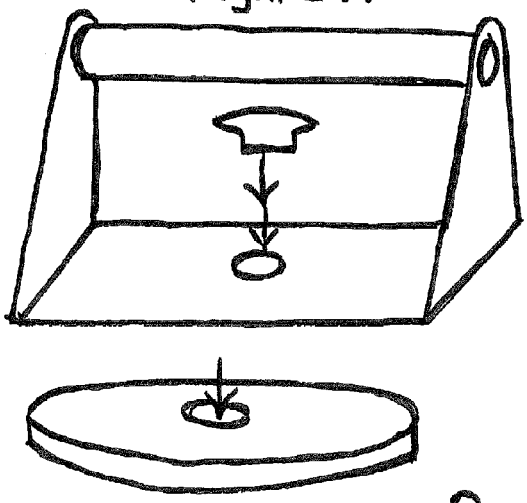
FIG. 11 is an isometric view illustrating how the plug secures the alternative gliding surface to the device base using the central plug.

FIG. 11 is an isometric view depicting how the plug 13 is placed through the central hole 4 locking the alternative accessory gliding surface in place.

Figure 12:
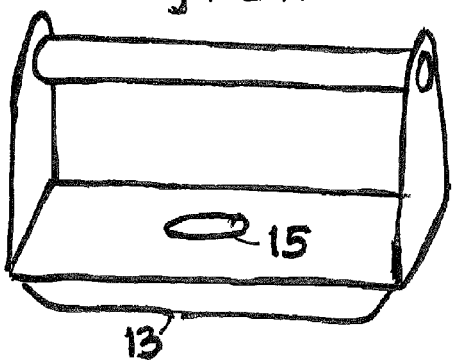
FIG. 12 is an isometric view with the alternative gliding surface attached.

FIG. 12 is an isometric view illustrating the alternative accessory gliding surface 13 attached using the plug 15 from a front view.

Figure 13:
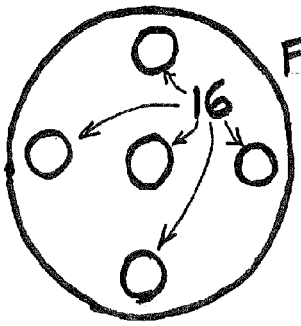
FIG. 13 is an isometric view of the undersurface of the gliding surface with felt or other removable pads stuck with a removable adhesive backing to convert the gliding ability to variety of flooring.

FIG. 13 is an isometric view of the alternative accessory gliding surface with removable adhesive circular (although not limited to that shape) felt pads 16 for use on hard surfaces.

Figure 14:
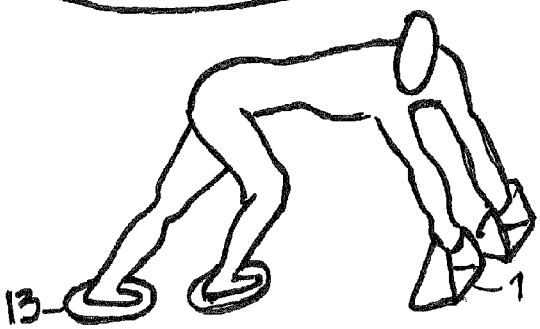
FIG. 14 is an isometric view of a user disengaging the gliding surface from the device and using them on the user's feet for other exercises.

FIG. 14 is an isometric view of an individual who has removed the alternative surface 13 and placed them on his feet to perform lower extremity and abdominal exercises.

Figure 15:
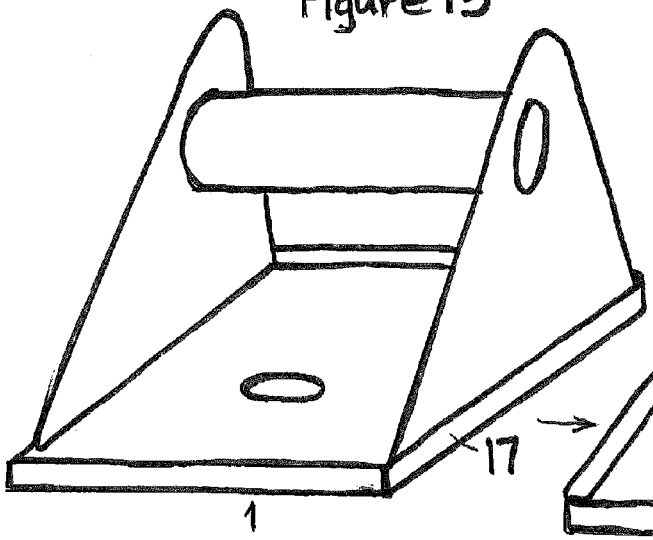
FIG. 15 is an isometric view of the device with another removable gliding surface.

FIG. 15 is an isometric view of the exercise device 1 with another alternative accessory gliding surface 17 added.

Figure 16:
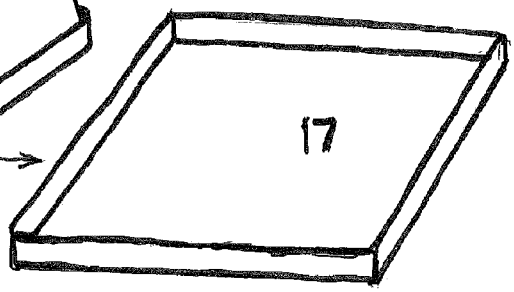
FIG. 16 is an isometric view of the alternate gliding surface which adheres to the device using raised edges.

FIG. 16 is an isometric view of the alternative accessory gliding device 17. This accessory gliding surface is raised slightly on the edges so that it can fit over the base of the exercise device 1.

Figure 17:
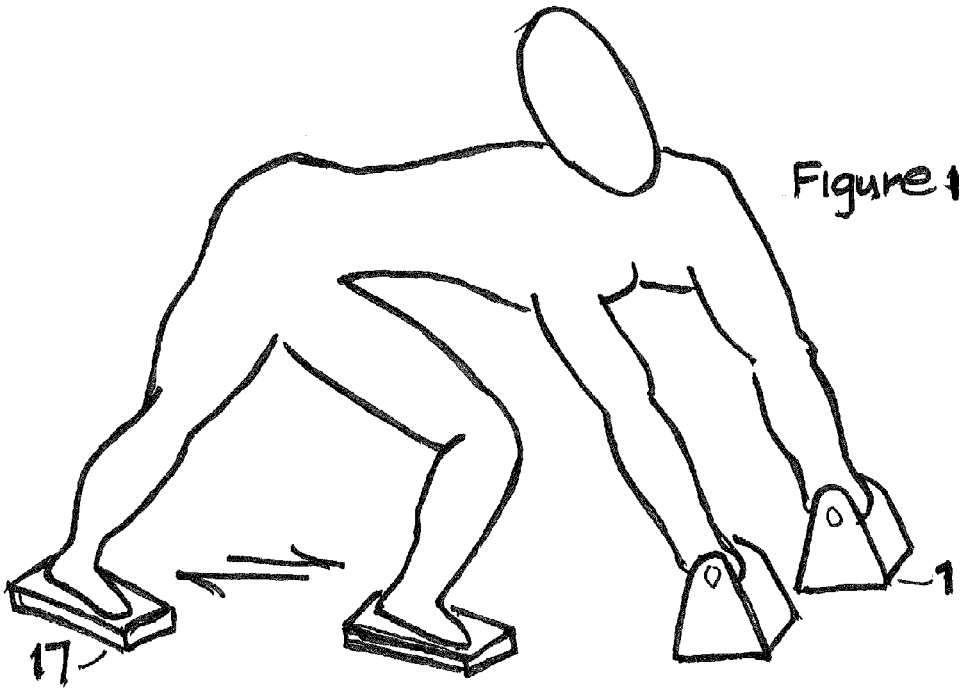
FIG. 17 is an isometric view of a user disengaging the gliding surfaces and using them on the user's feet for other exercises.

FIG. 17 is an isometric view of an individual who has removed the accessory gliding surface 17 and placed them on his feet to perform lower extremity and abdominal exercises.

Figure 18:
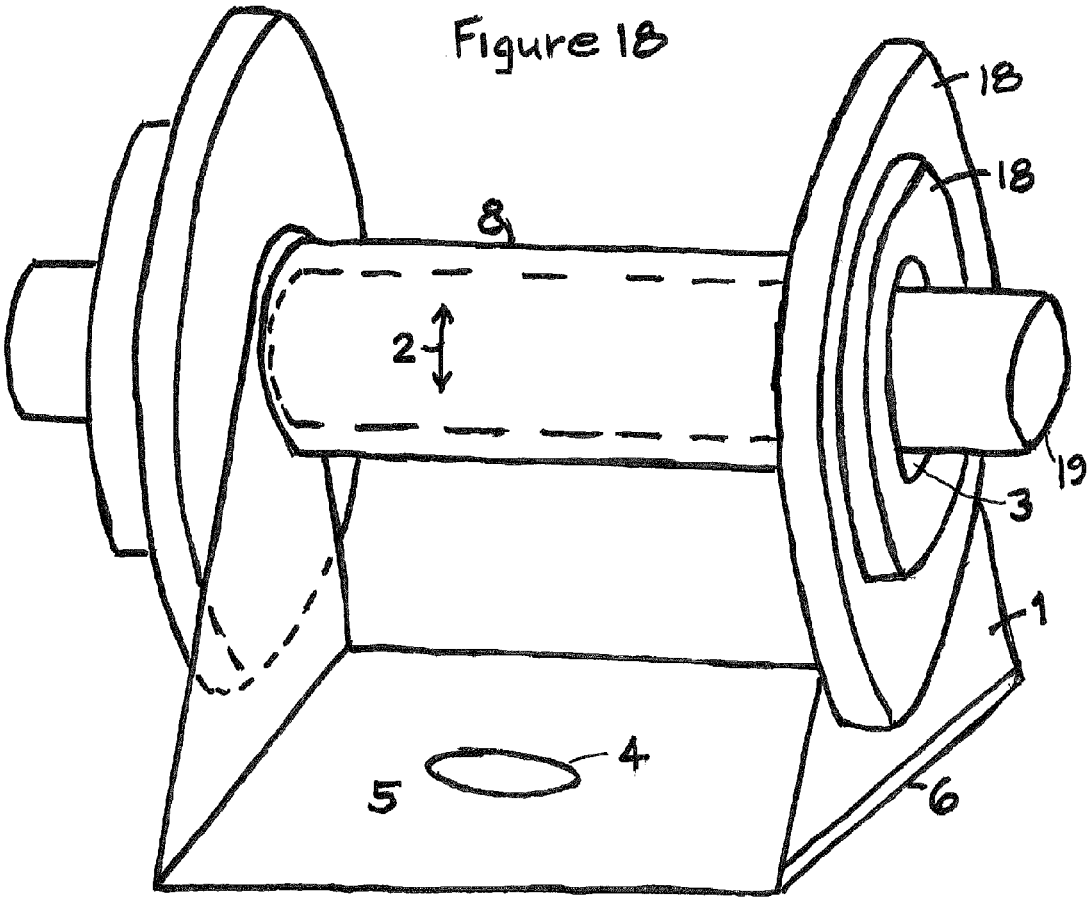
FIG. 18 is an isometric view of the exercise device with a dumbbell bar through the handle (which is hollow in this embodiment but may be solid in other embodiments) and free weight plates added. The device acts as an adjustable dumbbell in this embodiment. Locking clips can be added but are not illustrated here. In other embodiments the weight bar may attach by different methods or the handle and weight bar may be one solid piece. In another embodiment the weight bar may be threaded and the locking mechanism a nut.

FIG. 18 is an isometric view of the exercise device 1 with an additional weight bar 19 and free weight plates 18 added. This illustrates that a standard dumbbell bar or custom weight bar or bolt can be inserted through the opening 3 and contained in the hollow handle 2. The ends of the weight bar/bolt extend out the openings 3 on both sides of the device. Free weights can be added to these ends of the weight bar on both sides as illustrated. Standard locking clips (not illustrated) of a variety of styles sold for dumbbells can be used to lock the weights on both ends. This embodiment allows the device to act as a weighted gliding device and also as a dumbbell. In another embodiment the handle 2 and weight bar 14 may be one solid piece as opposed to a bar 14 inside a tube 2 as described above. In an additional embodiment the handle 2 may be omitted as described later in FIGS. 56 and 57.

Figure 19:
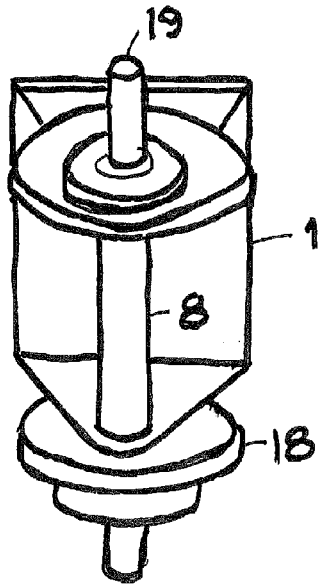
FIG. 19 is an isometric view from a top view of the exercise device with the dumbbell bar through the handle and free weight added.

FIG. 19 is an isometric view of the exercise device described in FIG. 18 from an aerial view.

Figure 20:
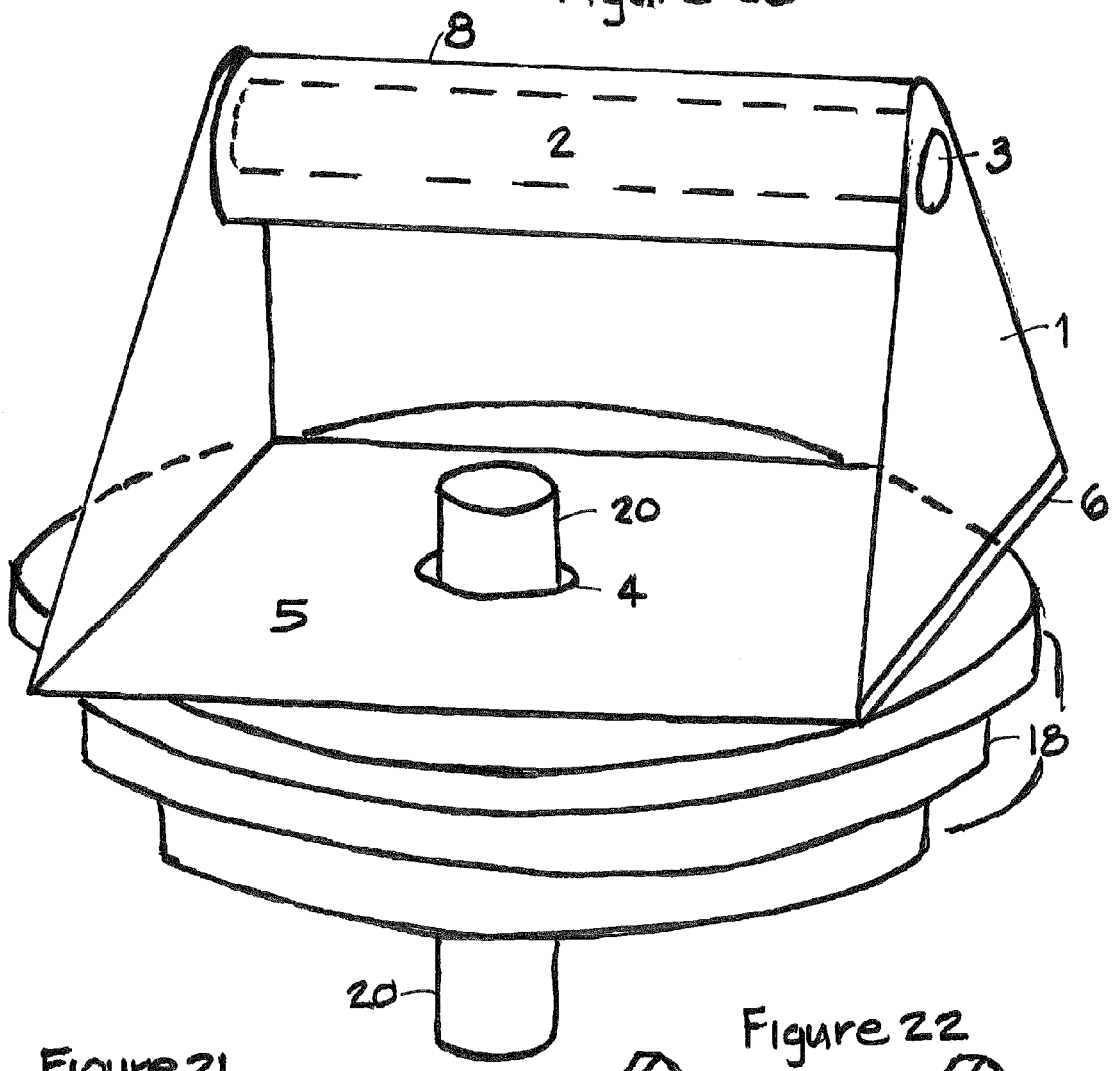
FIG. 20 is an isometric view of the exercise device with a bar or bolt (threaded or unthreaded) inserted through the opening in the base with free weights added. This figure shows the device as an adjustable kettle bell. Locking clips or nuts can be added to secure the weight but are not illustrated.

FIG. 20 is an isometric view of the exercise device 1 with the addition of a weight bar or bolt 20 and free weights 18 added in a different configuration. In this embodiment the weight bar is inserted through the opening 4 in the base 5. Free weights can be added to the weight bar below the base 5. Standard locking clips (not illustrated) can be used to lock the ends of the weight bar above the base 5 and below the weights 18. In another embodiment a threaded or unthreaded bolt can be substituted for the weight bar. The bolt would also be inserted through the opening 4 in the base 5. Weights can then be added over the bolt below the base 5 and a nut or locking clip (not illustrated) can be used as the locking mechanism below the weights. This embodiment allows the device to act as a kettle bell exercise device.

Figure 21:
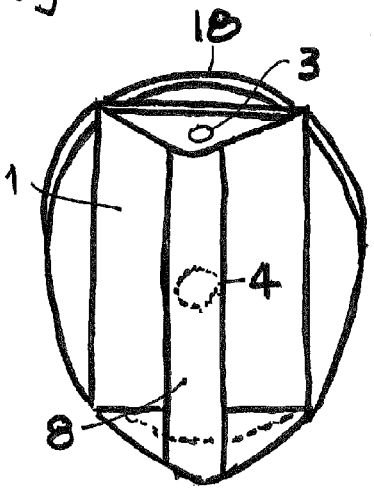
FIG. 21 is an isometric view of the same device in FIG. 20 from a top view.

FIG. 21 is an isometric view of the device described in FIG. 20 from an aerial view.

Figure 22:
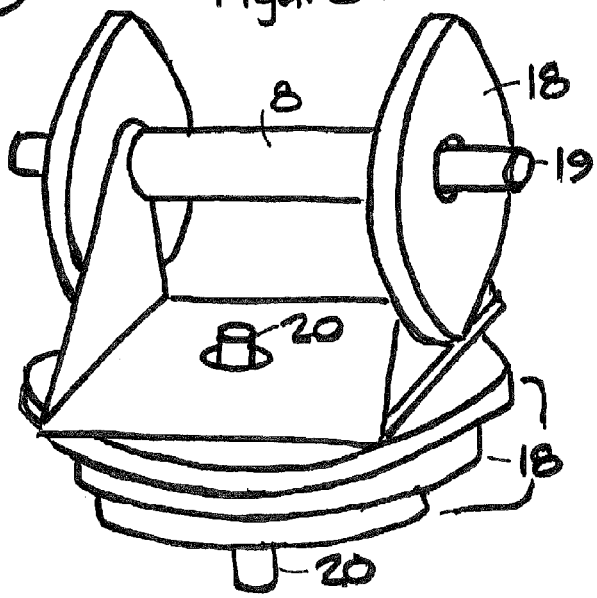
FIG. 22 is an isometric view of the exercise device with a combination of free weights added to a dumbbell bar in the handle and also weights added to a bar or bolt at the base. This figure depicts the device as a combination adjustable dumbbell and an adjustable kettle bell.

FIG. 22 is an isometric view of the exercise device with weight bars added both through the handle 2 and the base opening 4 in a dumbbell/kettle hell hybrid. This embodiment allows the user to add more weight than a standard dumbbell can accommodate and can be used for unique exercise applications.

Figure 23:
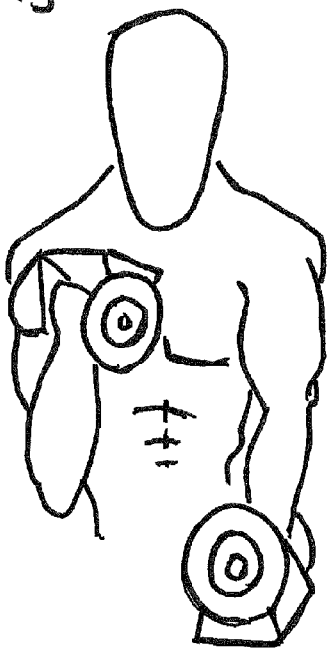
FIG. 23 is an isometric view of an individual using the device as an adjustable dumbbell.

FIG. 23 is an isometric view of an individual using the device described in FIG. 18 as a dumbbell.

Figure 24:
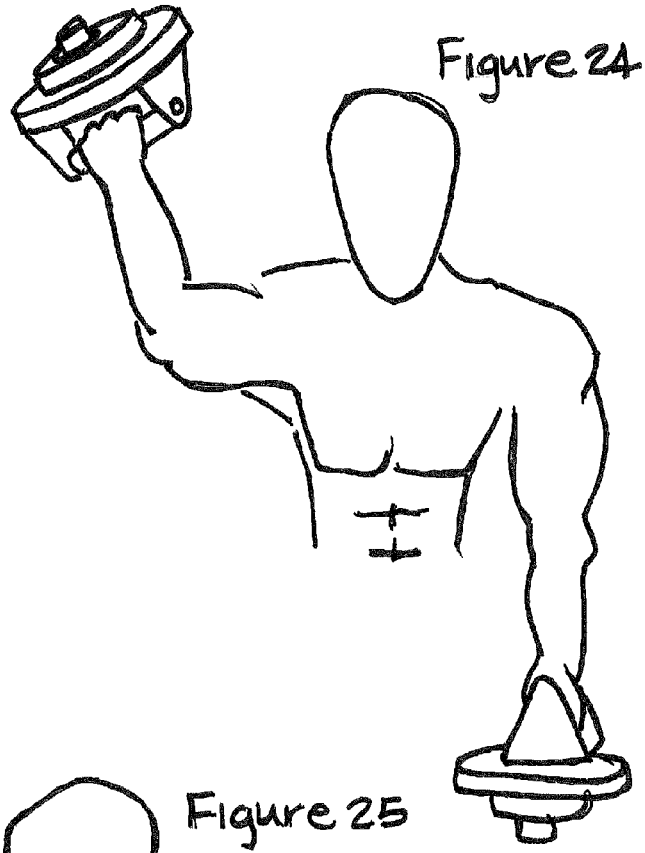
FIG. 24 is an isometric view of an individual using the device as an adjustable kettle bell.

FIG. 24 is an isometric view of an individual using the device described in FIG. 20 as a kettle bell.

Figure 25:
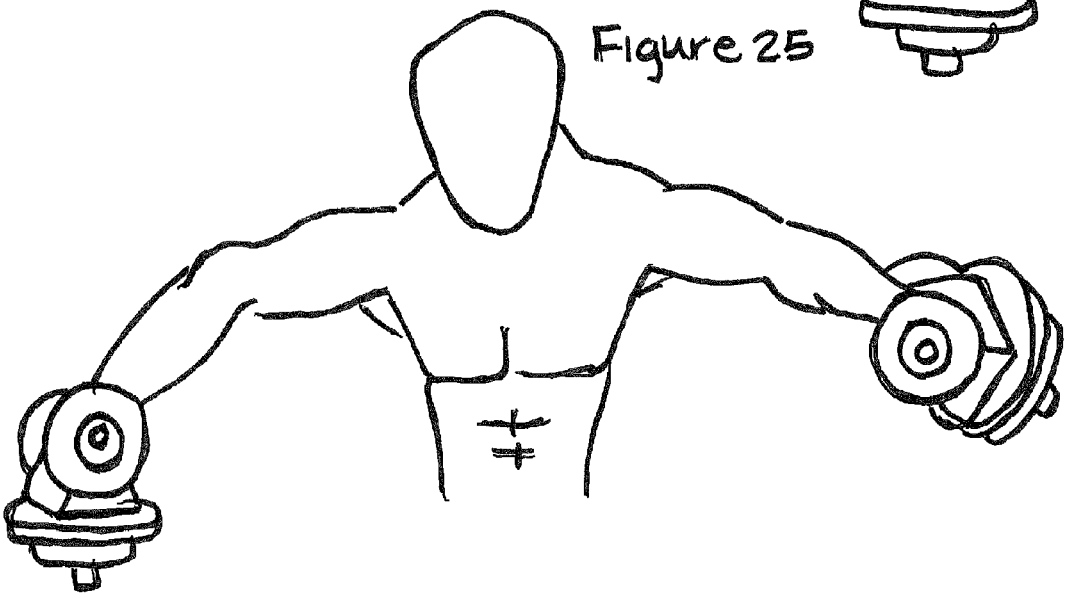
FIG. 25 is an isometric view of an individual using the device as a combination adjustable dumbbell and kettle bell.

FIG. 25 is an isometric view of an individual using the device described in FIG. 22 as a unique exercise device.

Figure 26:
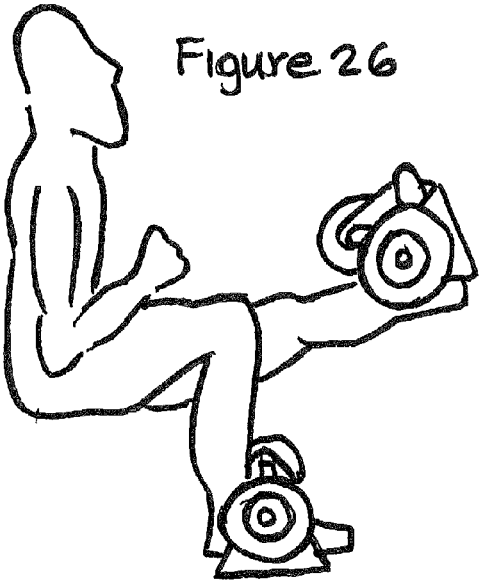
FIG. 26 is an isometric view of the device being used as a lower extremity exercise device. This view shows how the foot inserts in the device using dumbbell weights and a foot strap (not illustrated)

FIG. 26 is an isometric view of an individual using the device described in FIG. 18 for lower extremity exercises particularly leg extension exercises.

Figure 27:
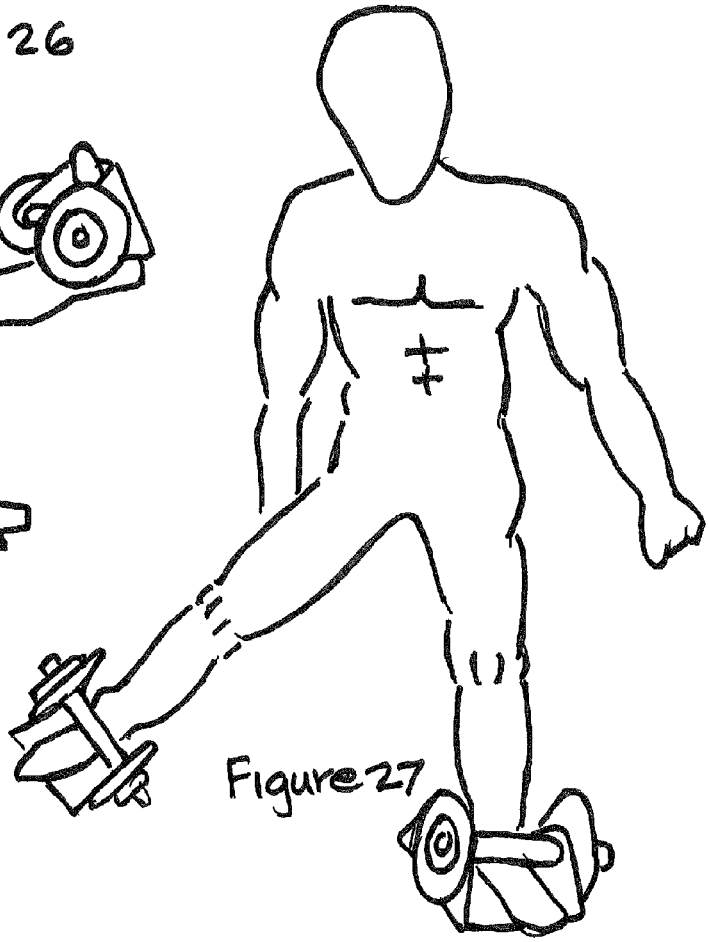
FIG. 27 is an isometric view of another lower extremity exercise.

FIG. 27 is an isometric view of an individual using the device described in FIG. 18 for leg abduction exercises.

Figure 28:
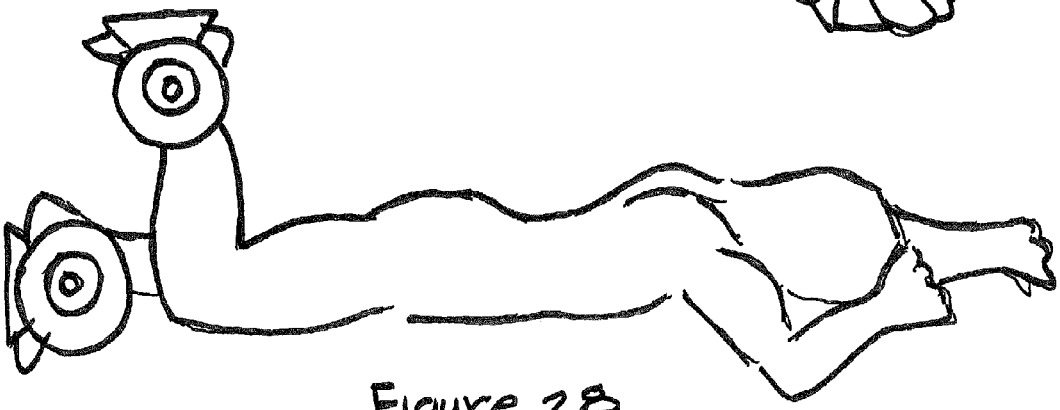
FIG. 28 is an isometric view of another lower extremity exercise.

FIG. 28 is an isometric view of an individual using the device described in FIG. 18 for leg curl exercises. A foot strap similar to that to be depicted in FIG. 29 may be added.

Figure 29:
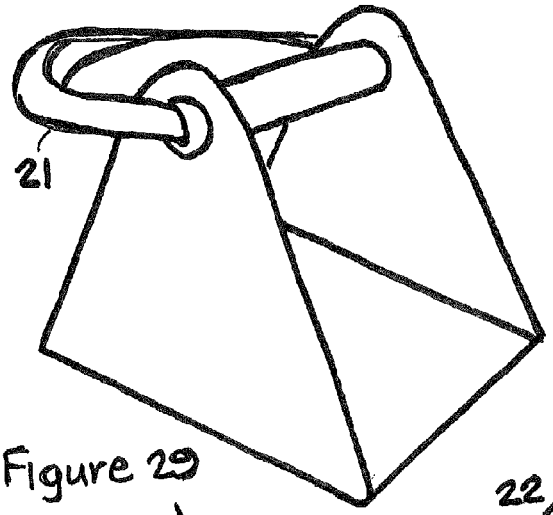
FIG. 29 is an isometric view of the exercise device with a foot strap placed through the handle. In another embodiment the strap can be wrapped around the handle.

FIG. 29 is an isometric view the exercise device 1 with a foot strap 21 added through the handle 2. The strap can be a simple Velcro® or clasp strap. The strap may also be applied around the handle 2 (not illustrated) if weights are added through the handle 2.

Figure 30:
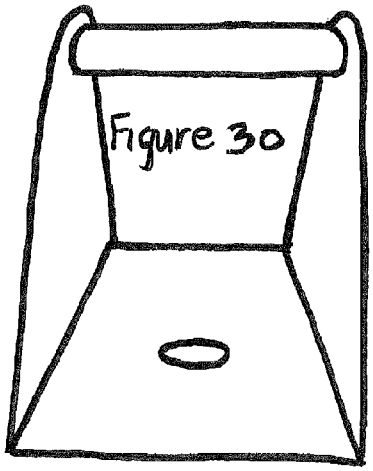
FIG. 30 is an isometric view of the device from a front view.

FIG. 30 is an isometric view of the exercise device 1 from the front view.

Figure 31:
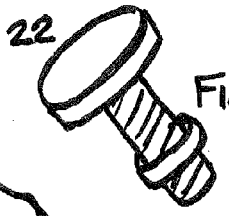
FIG. 31 is an isometric view of a threaded bolt that can be inserted through the central hole to apply free weights.

FIG. 31 is an isometric view of a threaded bolt/nut 22.

Figure 32:
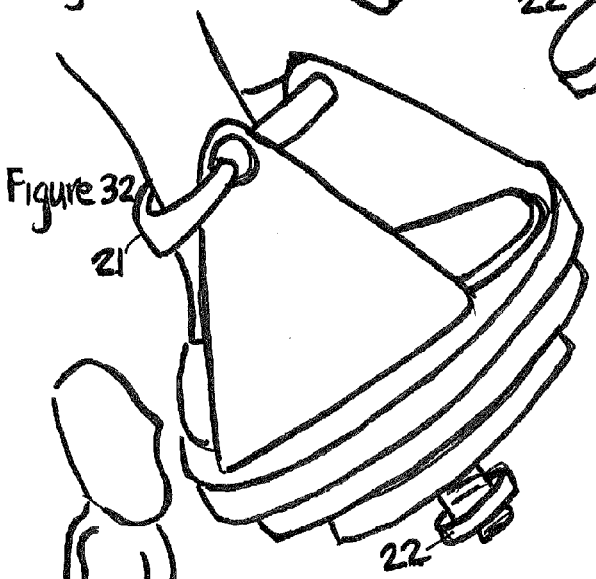
FIG. 32 is an isometric view of an individual using the device for lower extremity exercises utilizing the bolt, free weights and foot strap.

FIG. 32 is an isometric view of the exercise device 1 with the threaded bolt 22 placed through the base opening 4 and free weights added below the base 5. The weights are secured with a nut 22. The foot strap 21 has also been added to secure the foot in the device.

Figure 33:
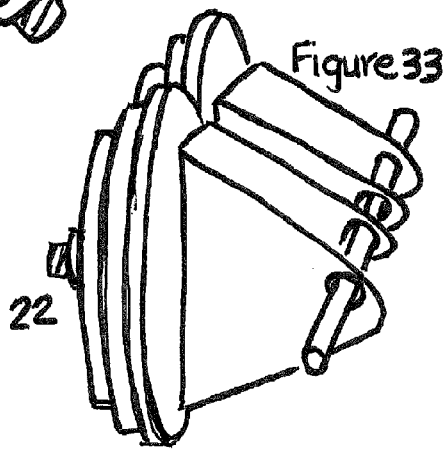
FIG. 33 is an isometric view of two devices connected using a dumbbell bar through the handles for lower extremity exercises.

FIG. 33 is an isometric view of a pair of the exercise devices 1 as depicted in FIG. 32. Using a dumbbell bar 19 or any standard bar or bolt the pair can be secured together and locked using a variety of clips, clasps or nuts (not illustrated).

Figure 34:
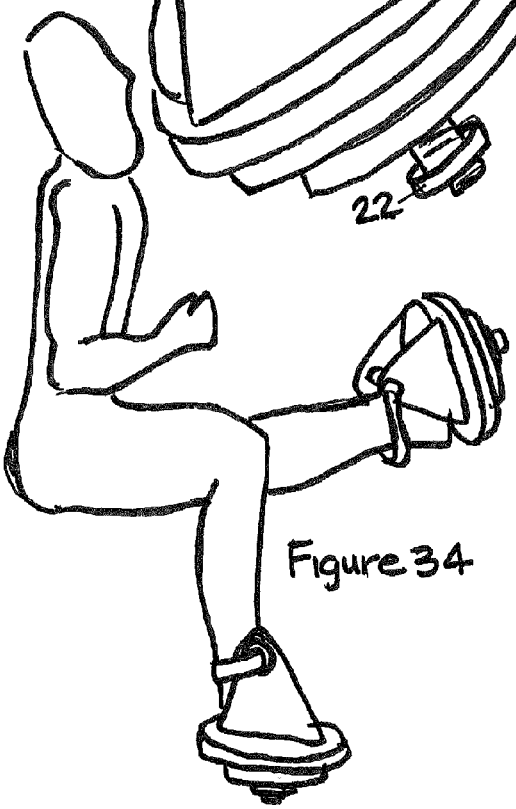
FIG. 34 is an isometric view of an individual using a single lower extremity device

FIG. 34 is an isometric view of an individual using the device as described in FIG. 32 for lower extremity exercises.

Figure 35:
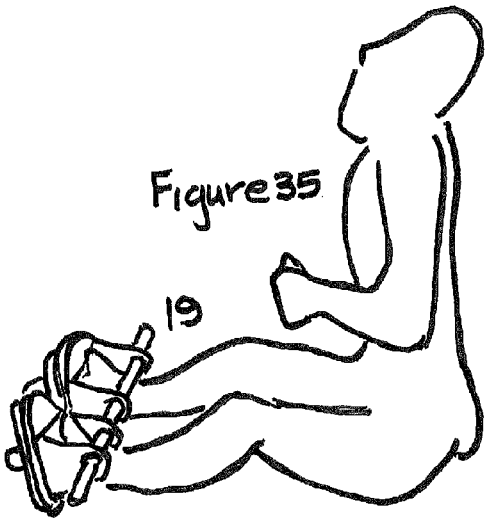
FIG. 35 is an isometric view of an individual using the dual lower extremity device.

FIG. 35 is an isometric view of an individual using a pair of the exercise devices as described in FIG. 33 locked together.

Figure 36:
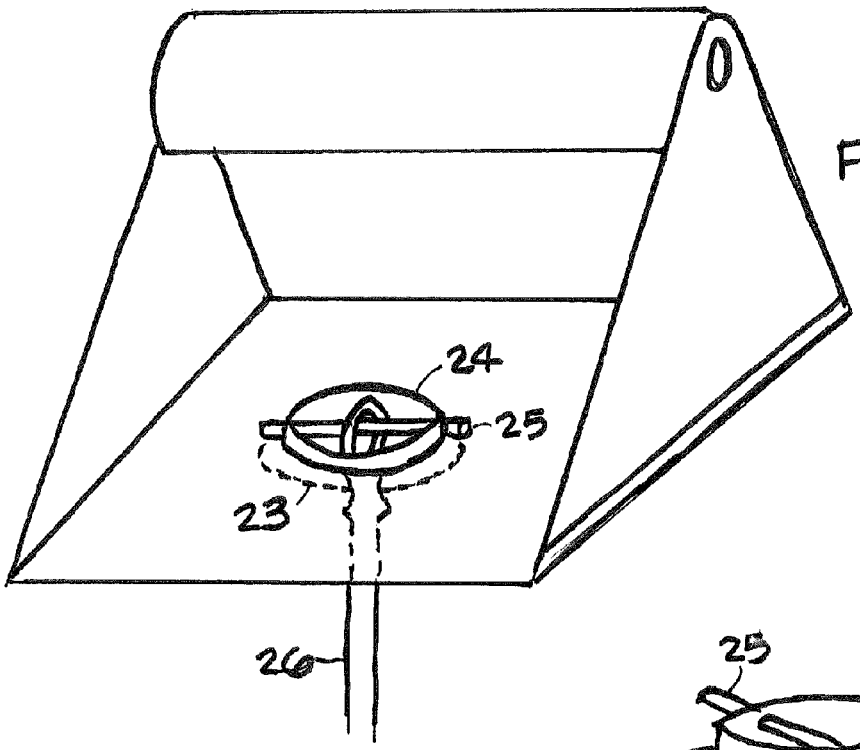
FIG. 36 is an isometric view of the device with a central plug added to attach an exercise band.

FIG. 36 is an isometric view of the exercise device 1 with an elastic exercise band or pulley rope secure through the base opening 4.

Figure 37:
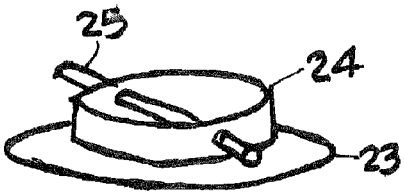
FIG. 37 is an isometric view of the central plug for exercise hand attachment.

FIG. 37 is an isometric view of the locking plug utilized in FIG. 36. The plug is comprised of a basic plug larger at its base 23 with a raised portion 24 to fit through the base opening and a locking bolt 25 that goes through two holes in the raised portion.

Figure 38:
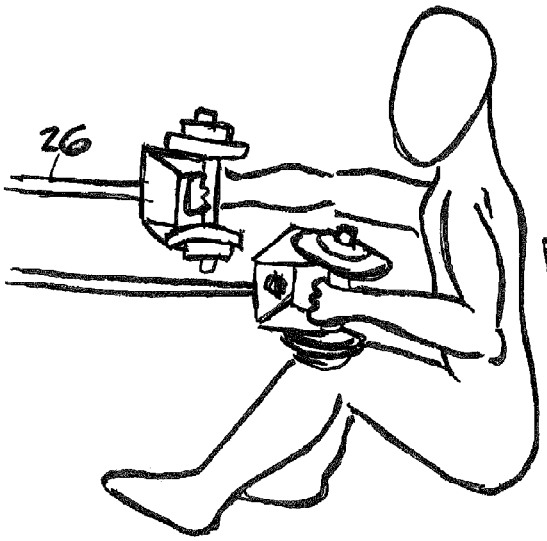
FIG. 38 is an isometric view of an individual using the device with the plug, hand and dumb-bells for weighted rowing exercises.

FIG. 38 is an isometric view of an individual using the device as described in FIG. 36 with weights added through the handles as a weighted rowing handle.

Figure 39:
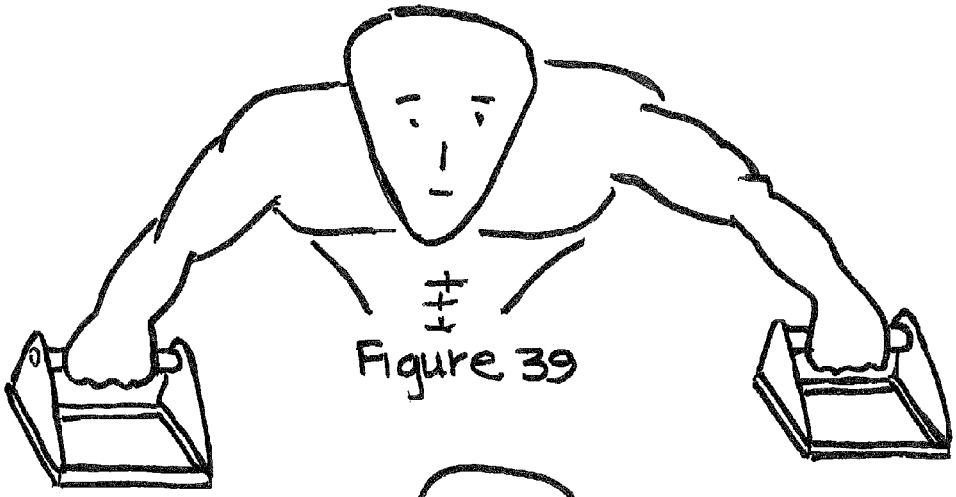
FIG. 39 is an isometric view of an individual performing a lateral gliding exercise with a front grip.

FIG. 39 is an isometric view of an individual using the exercise device 1 for either push-ups or lateral gliding exercises (front grip).

Figure 40:
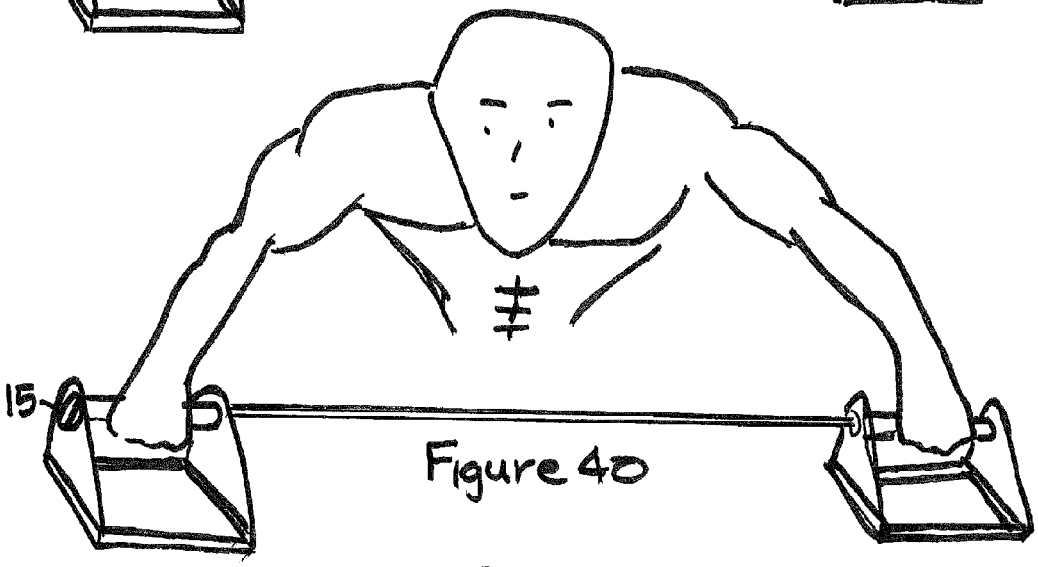
FIG. 40 is an isometric view of an individual performing a lateral gliding exercise (front grip) utilizing an exercise band attached through the handle secured with a plug (similar to FIG. 9). The band can be useful for rebounding.

FIG. 40 is an isometric view of an individual using the device for lateral gliding exercises. In this embodiment an elastic exercise band can be added through the handle 2 and secured using a simple plug similar to 15 in FIG. 9. The band can be used to increase resistance or help in rebounding.

Figure 41:
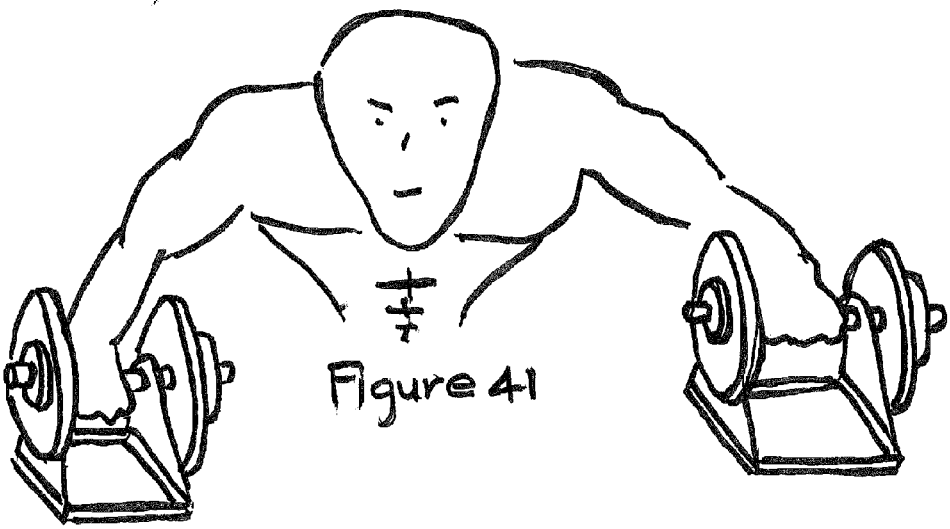
FIG. 41 is an isometric view of an individual performing a lateral gliding exercise (front grip) with free weights added through the handle.

FIG. 41 is an isometric view of an individual using the device described in FIG. 18 for lateral gliding exercises (front grip). Adding weights can add resistance.

Figure 42:
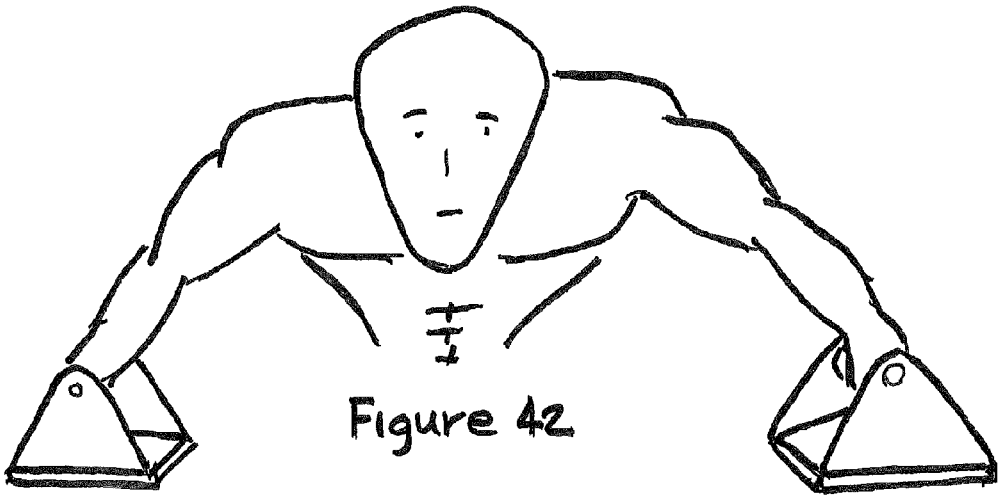
FIG. 42 is an isometric view of individual performing a lateral gliding exercise side grip.

FIG. 42 is an isometric view of an individual performing the same exercises as FIG. 39 with a lateral grip.

Figure 43:
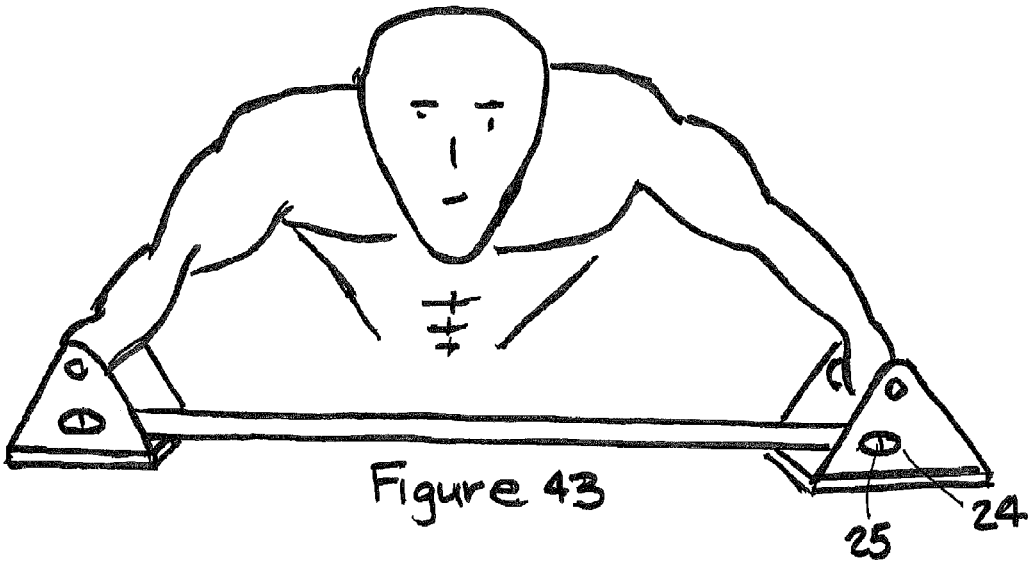
FIG. 43 is an isometric view of an individual performing a lateral gliding exercise (side grip) utilizing an exercise band attached through the central hole secured with a plug (similar to FIG. 37). The band assists in rebounding.

FIG. 43 is an isometric view of an individual performing the same exercises as FIG. 40 the elastic band in this embodiment is connected using a plug similar to FIG. 37

Figure 44:
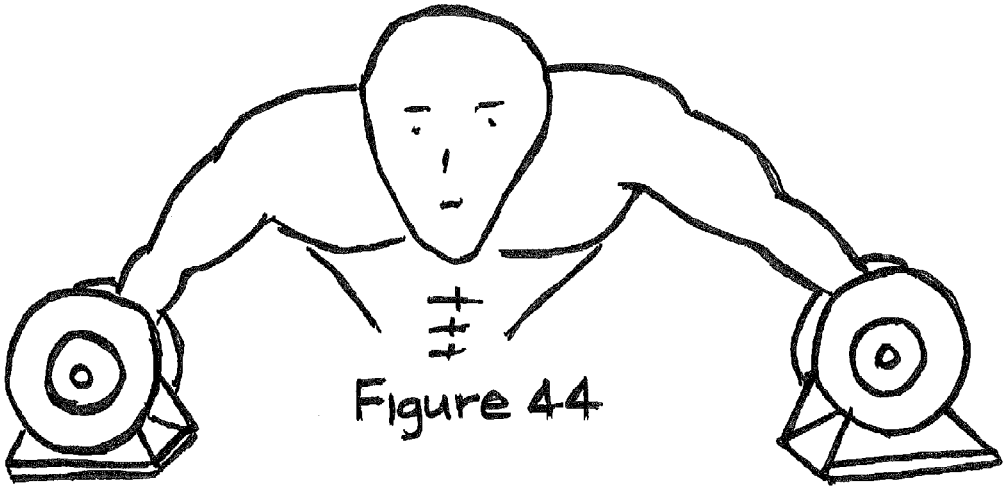
FIG. 44 is an isometric view of an individual performing a lateral gliding exercise (side grip) with free weights added.

FIG. 44 is an isometric view of an individual performing the same exercises as FIG. 41 with a lateral grip.

Figure 45:
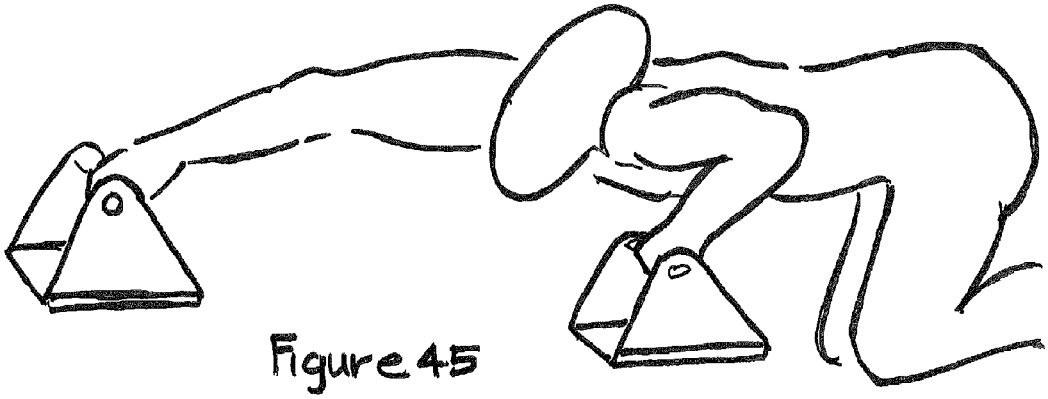
FIG. 45 is an isometric view of an individual performing forward gliding exercises with a front grip.

FIG. 45 is an isometric view of an individual using the exercise device 1 for forward gliding exercises (front grip)

Figure 46:
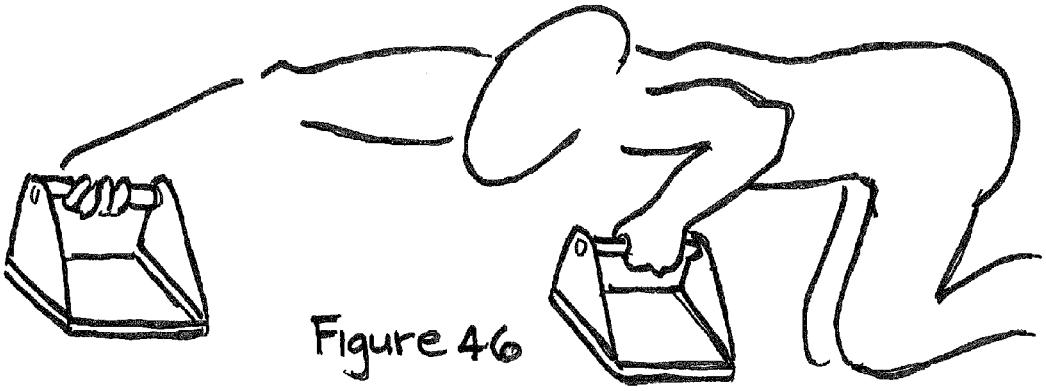
FIG. 46 is an isometric view of an individual performing forward gliding exercises with a side grip.

FIG. 46 is an isometric view of an individual performing the same exercises as FIG. 45 with a lateral grip.

Figure 47:
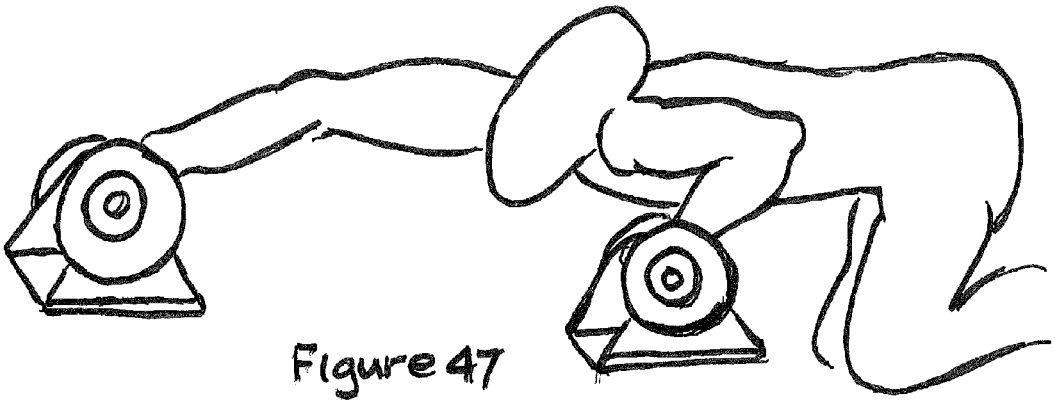
FIG. 47 is an isometric view of an individual performing forward gliding exercises (front grip) with free weights added.

FIG. 47 is an isometric view of an individual performing forward gliding exercises using the device similar to FIG. 18.

Figure 48:
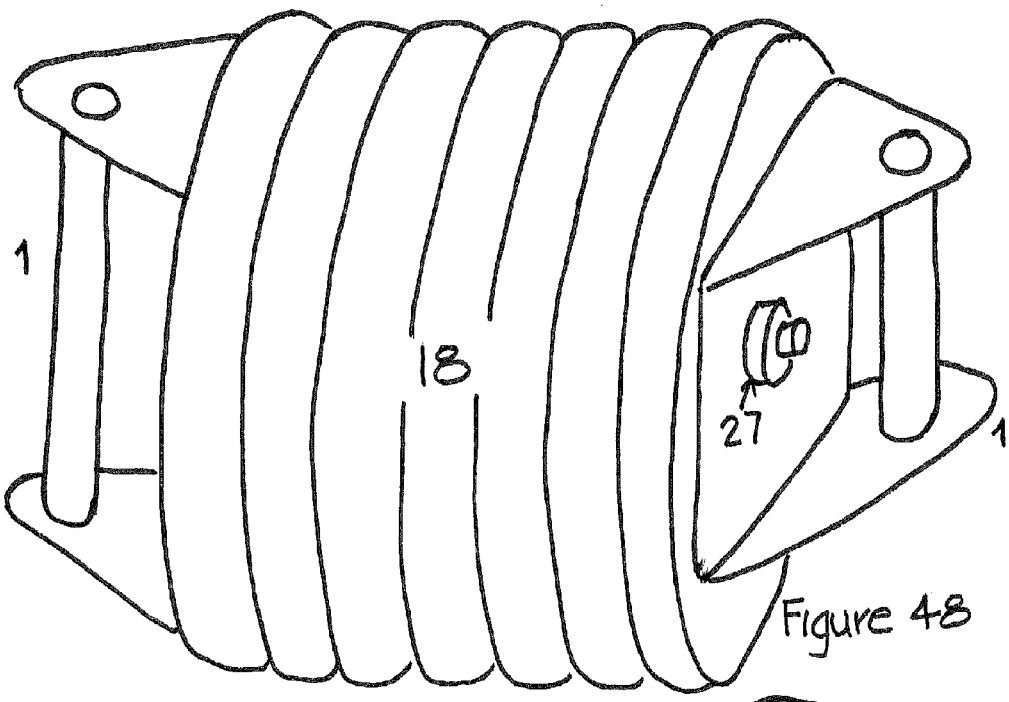
FIG. 48 is an isometric view of a pair of the exercise devices with multiple free weight plates connected between them utilizing a central bar or bolt in the central hole and locked on each end with a nut.

FIG. 48 is an isometric view of a pair or the exercise devices 1 with multiple free weight plates 18 locked between the pair using a threaded bar and nut 27. In another embodiment a similar smooth bar with clips or bolt can be used.

Figure 49:
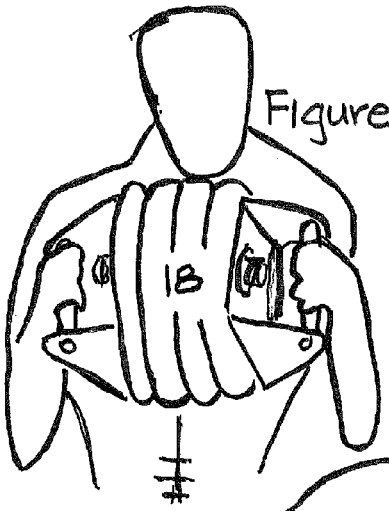
FIG. 49 is an isometric view of an individual using the configuration in FIG. 48 for bicep curls.

FIG. 49 is an isometric view of an individual using the device described in FIG. 48 for curling exercises.

Figure 50:
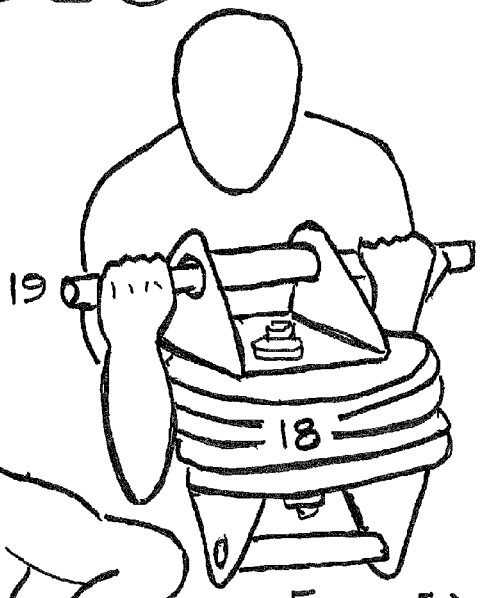
FIG. 50 is an isometric view of an individual using the configuration in FIG. 48 however a dumbbell bar has been added through the handle also for bleep curls.

FIG. 50 is an isometric view of an individual using the device described in FIG. 48 with a dumbbell bar (or similar bar) placed through the handle 2 for a different style curling exercise.

Figure 51:
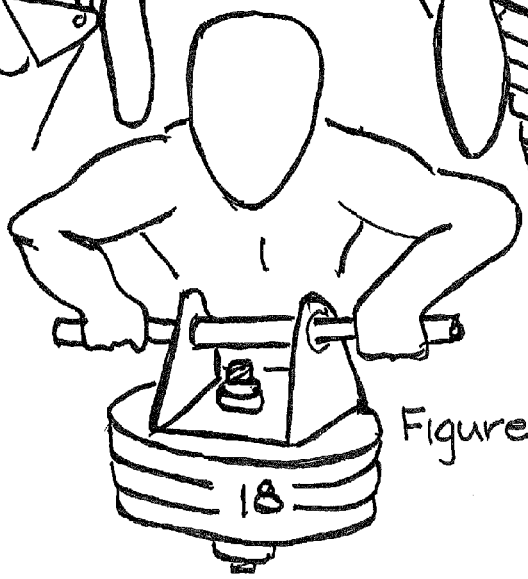
FIG. 51 is an isometric view of an individual using the configuration in FIG. 50 for T-bar exercises.

FIG. 51 is an isometric view of an individual using the device described in FIG. 50 for T-bar exercises.

Figure 52:
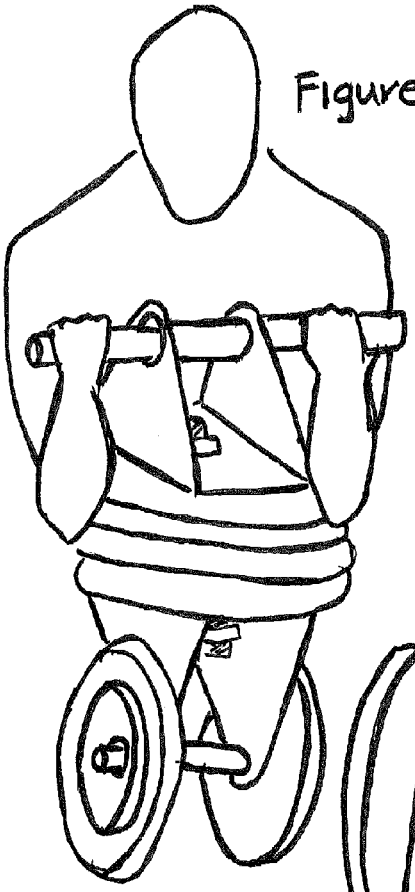
FIG. 52 is an isometric view of an individual using the configuration in FIG. 50 with additional weight added using an additional dumbbell bar and weight on the bottom.

FIG. 52 is an isometric view of an individual performing the same exercise as FIG. 50 however additional weight can be added by placing a second bar through the second handle 2 of the other device and adding more weight.

Figure 53:
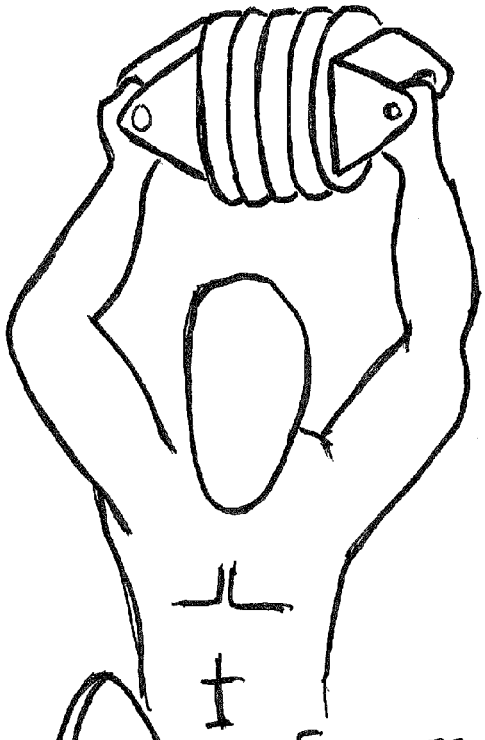
FIG. 53 is an isometric view of an individual using the configuration in FIG. 48 for military press exercises.

FIG. 53 is an isometric view of an individual performing military press exercises using the device as described in FIG. 48.

Figure 54:
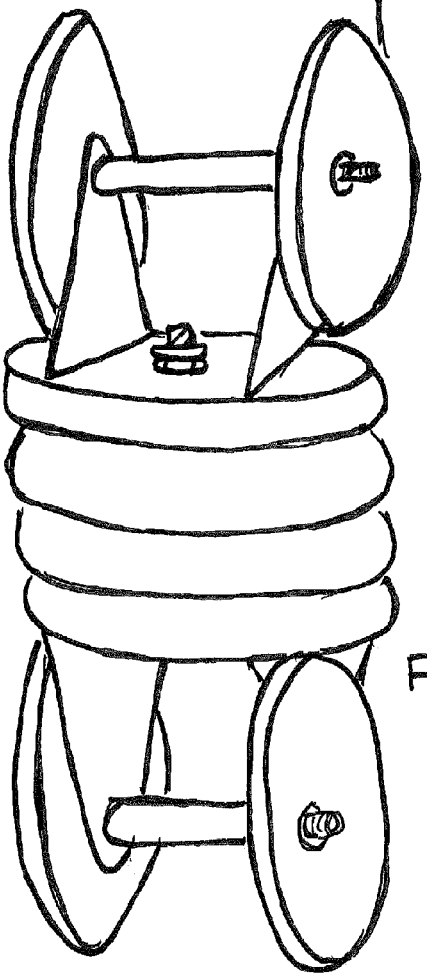
FIG. 54 is an isometric view of the configuration in FIG. 48 with additional weight added through each handle with dumbbell bars and weights.

FIG. 54 is an isometric view of the device described in FIG. 48 with additional weight added utilizing the bars and free weights added through both handles 2.

Figure 55:
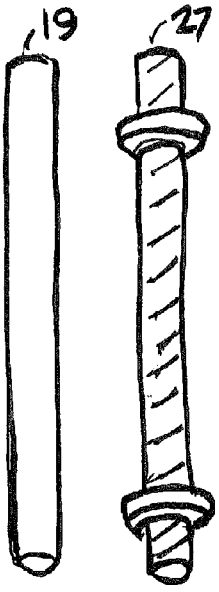
FIG. 55 is an isometric view of the types of bars that can be used in FIGS. 48-54, such as a threaded bar (or bolt) and nuts and a smooth bar as a handle.

FIG. 55 is an isometric view of bars (but not limited to) that can be used in FIGS. 48-54. The bar can be smooth 19 or threaded 27.

Figure 56:
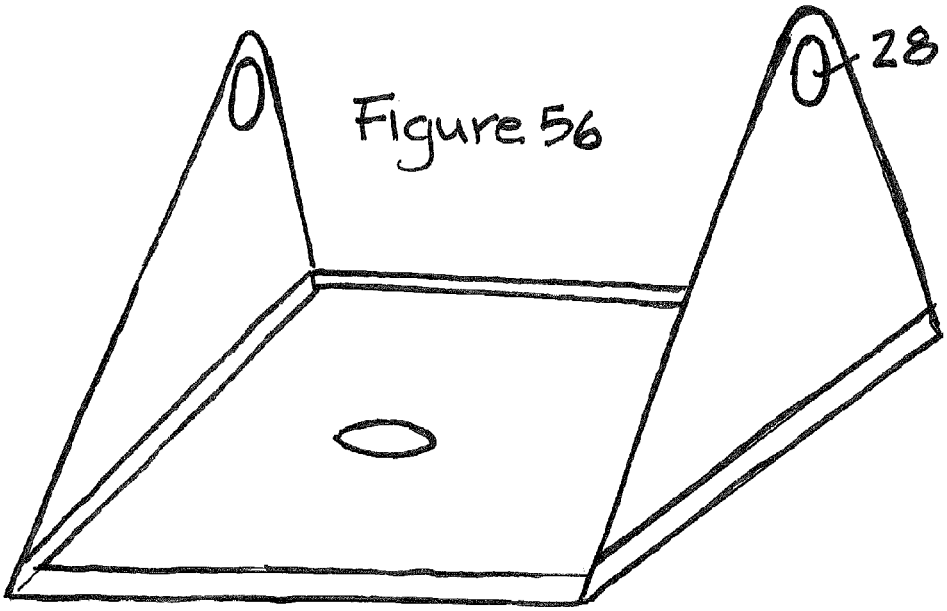
FIG. 56 is an isometric view of an alternative device without a handle. A dumbbell bar may be inserted through its holes.

FIG. 56 is an isometric view of an alternative to the exercise device 1. In this embodiment the handle 2 has been omitted. A dumbbell bar can be inserted through the openings 28.

Figure 57:
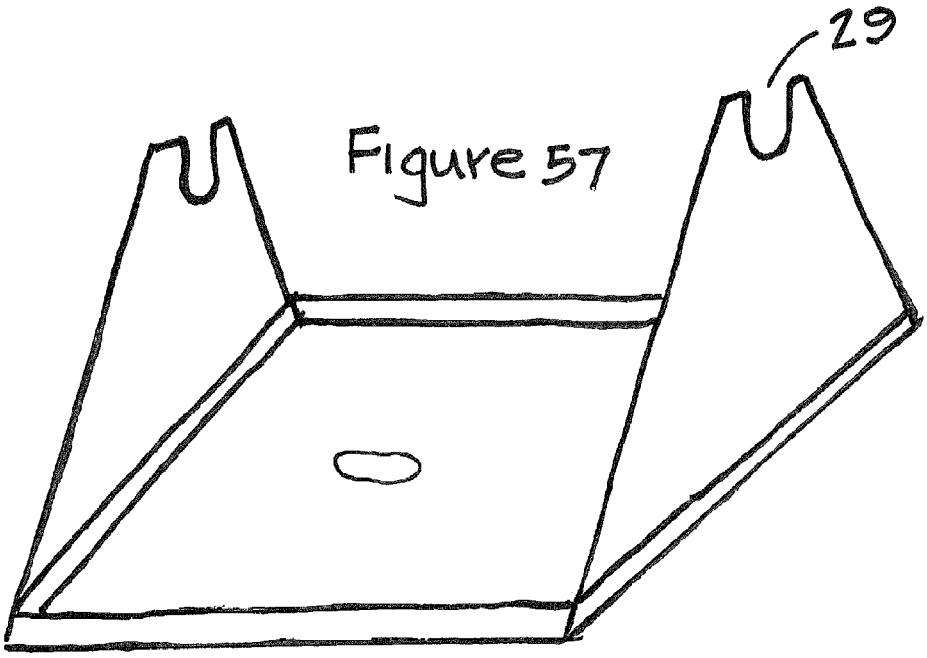
FIG. 57 is an isometric view of another alternative device in which the dumbbell bar would rest in the open ended holes.

FIG. 57 is an isometric view of another alternative to the exercise device 1. Again the handle 2 has been omitted. A dumbbell bar can be placed on top of the opening 29.

SUMMARY

While the above description mentions certain variations in the construction and operation of the multiple use exercise device (and accessories) thus far described other variations are possible within the scope of the invention. Those skilled in the art will recognize that only selected preferred embodiments of the invention have been depicted and described, and it will be understood that various changes and modifications can be made other than those specifically mentioned above without departing from the spirit and scope of the invention, which is defined solely by the claims that follow.

What is claimed is:

1. An exercise apparatus capable of being used in multiple configurations with a plurality of accessories, the apparatus comprising:

at least one exercise device including (i) a base with a first side and a second side presenting a flat major surface with a hole disposed substantially centrally relative to the base second side and passing through the base between the first and second sides, (ii) upstanding, spaced-apart frame members rigidly attached to the base and extending from the first side, and (iii) a handle spanning the upstanding frame members and being directly connected thereto at a location spaced from the base for grasping by a user of the apparatus, wherein the handle is a hollow cylinder directly connected to the upstanding frame members and having openings at both ends;

a plurality of generally disc-shaped standard free weights, each having opposing mutually parallel, substantially planar free weight major surfaces and a single hole disposed substantially centrally of the disc and passing therethrough between the major surfaces thereof;

at least one connection member configured to assume either of (i) a first orientation wherein it passes through the hole through the base and the hole in at least one of the plurality of free weights, and (ii) a second orientation wherein it passes through the hollow handle and the hole in each of at least one of the plurality of free weights at a respective end of the handle; and locking members for engaging end portions of the at least one connection member, wherein:

when the at least one connection member is in the first orientation the locking members removably attach the at least one of the plurality of free weights to the exercise device with one of the free weight major surfaces of the at least one of the plurality of free weights in contact with the flat major surface of the base second side by engaging the end portions of the at least one connection member extending beyond the base first side and beyond a free weight major surface not in contact with the base second side, and when the at least one connection member is in the second orientation the locking members removably attach the at least one of the plurality of free weights to the exercise device at each respective end of the handle by engaging the end portions of the at least one connection member, wherein the at least one connection member extends beyond the at least one of the plurality of free weights at each end of the handle.

2. The exercise apparatus in claim 1, wherein the at least one connection member comprises a first rod and a second rod, and the locking members comprise removable locking clips that fit on ends of the rods to secure the at least one of the plurality of free weights onto the first rod at the base and the at least one of the plurality of free weights onto the second rod at each end of the handle.

3. The exercise apparatus in claim 2, wherein the planform shape of the base is one of square, rectangular, circular, and oblong.

4. The exercise apparatus in claim 2, wherein the handle is padded.

5. The exercise apparatus in claim 2, wherein multiple ones of the plurality of free weights are secured to at least one of the base second side and each end of the handle, with one of the free weight major surfaces of a first free weight of the multiple ones of the plurality of free weights in contact with one of the free weight major surfaces of a second free weight of the multiple ones of the plurality of free weights.

6. The exercise apparatus in claim 1, wherein the at least one connection member is one (1) a weight bar on which the at least one of the plurality of free weights can be secured with weight end clips at both ends of the weight bar, and (2) a threaded bolt on which the at least one of the plurality of free weights can be secured using a separate threaded nut at each end of the threaded bolt.

7. The exercise apparatus in claim 1, wherein the upstanding frame members of the handle are spaced apart a distance sufficient to accept the user's foot therebetween, the apparatus further comprising a foot strap attached to the handle for securing the exercise device to the user's foot for a lower-extremity exercise.

8. The exercise apparatus in claim 1, further comprising a second exercise device including (i) a base with a first side and a second side presenting a flat major surface with a hole disposed substantially centrally relative to the base second side and passing through the base between the first and second sides, (ii) upstanding, spaced-apart frame members rigidly attached to the base and extending from the first side, and (iii) a handle spanning the entire distance between the upstanding frame members and being directly connected thereto at a location spaced from the base for grasping by the user of the apparatus, wherein the handle is a hollow cylinder directly connected to the upstanding frame members and having openings at both ends, the at least one connection member being of sufficient length to pass through the hollow handles of both exercise devices with the openings at one end of the handles in facing relation and to present end portions of the at least one connection member that extend beyond the openings in the handles at opposite ends thereof from the ends in facing relation for engagement of the end portions by respective locking members to removably attach both exercise devices together.

9. The exercise apparatus in claim 8, further comprising at least two additional connection members of sufficient length to pass through the hole through respective bases of each exercise device and the hole in the at least one of the plurality of free weights with one of the free weight major surfaces in contact with the flat major surface of the base second side, wherein each additional connection member extends beyond the respective base first side and beyond the free weight major surface not in contact with the base second side for engagement of end portions of each additional connection member by respective locking members to removably attach the at least one of the plurality of free weights to each of the two exercise devices.

10. The exercise apparatus in claim 9, wherein the upstanding frame members of the handles of the first and second exercise devices are spaced apart a distance sufficient to accept one of the user's feet between the upstanding frame members of each exercise device for a lower-extremity exercise.

11. The exercise apparatus in claim 8, wherein the at least one connection member is one of (1) a weight bar on which both exercise devices can be secured with weight end clips, and (2) a threaded bolt on which both exercise devices can be secured using threaded nuts.

12. The exercise apparatus in claim 8, wherein the upstanding frame members of the handles of the first and second exercise devices are spaced apart a distance sufficient to accept one of the user's feet between the upstanding frame members of each exercise device for a lower-extremity exercise.

13. The exercise apparatus in claim 1, further comprising a second exercise device including (i) a base with a first side and a second side presenting a flat major surface with a hole disposed substantially centrally relative to the base second side and passing through the base between the first and second sides, (ii) upstanding, spaced-apart frame members rigidly attached to the base and extending from the first side, and (iii) a handle spanning the entire distance between the upstanding frame members and being directly connected thereto at a location spaced from the base for grasping by the user of the apparatus, wherein the handle is a hollow cylinder directly connected to the upstanding frame members and having openings at both ends, the at least one connection member being of sufficient length to pass through the hole through respective bases of each exercise device and the hole in the at least one of the plurality of free weights with one of the free weight major surfaces in contact with the flat major surface of the base second side of either exercise device or with one of the free weight major surfaces of a second of the plurality of free weights and to present end portions of the at least one connection member that extend beyond the first sides of the respective bases for engagement by respective locking members to removably attach both exercise devices together with the at least one of the plurality of free weights disposed between the bases of the exercise devices.

14. The exercise apparatus in claim 13, further comprising a rod for passing through the hollow handle of one of the two exercise devices with end portions of the rod extending beyond the openings in the handle for grasping by the user.

15. The exercise apparatus in claim 14, further comprising a second connection member for passing through the hole in each of the at least one of the plurality of free weights at a respective end of the handle of the other of the two exercise devices and presenting end portions for engagement by additional locking members to removably attach the at least one of the plurality of free weights to each end of the handle of the other exercise device by engaging the end portions of the second connection member extending beyond the at least one of the plurality of free weights at each end of the handle.

16. The exercise apparatus in claim 13, wherein the at least one connection member is one of (1) a weight bar on which both exercise devices can be secured with weight end clips, and (2) a threaded bolt on which both exercise devices can be secured using threaded nuts.

* * * * *